US012303041B2

(12) United States Patent
Herrin et al.

(10) Patent No.: US 12,303,041 B2
(45) Date of Patent: May 20, 2025

(54) COMBINATION INFANT BOUNCER AND ROCKER

(71) Applicant: MUNCHKIN, INC., Van Nuys, CA (US)

(72) Inventors: Sean Quinton Herrin, South Pasadena, CA (US); Sung Yun Chan, Pasadena, CA (US); Nicholas Arthur Trumbo, Valencia, CA (US); Kevin Douglas Johnson, Tarzana, CA (US); Mau Chun Yip, Hong Kong (CN)

(73) Assignee: MUNCHKIN, INC., Van Nuys, CA (US)

( * ) Notice: Subject to any disclaimer, the term of this patent is extended or adjusted under 35 U.S.C. 154(b) by 16 days.

(21) Appl. No.: 18/114,211

(22) Filed: Feb. 24, 2023

(65) Prior Publication Data

US 2023/0263316 A1 Aug. 24, 2023

Related U.S. Application Data

(60) Provisional application No. 63/313,671, filed on Feb. 24, 2022.

(51) Int. Cl.
*A47D 13/10* (2006.01)
*A47D 15/00* (2006.01)

(52) U.S. Cl.
CPC ..... *A47D 13/107* (2013.01); *A47D 13/101* (2022.08); *A47D 15/008* (2013.01)

(58) Field of Classification Search
CPC ..... A47D 13/107; A47D 13/102; A47D 13/10
See application file for complete search history.

(56) References Cited

U.S. PATENT DOCUMENTS

| | | | | |
|---|---|---|---|---|
| 6,574,806 | B1 * | 6/2003 | Maher | A47D 9/057 297/260.2 |
| 6,682,148 | B1 * | 1/2004 | Chen | A47D 13/102 297/DIG. 11 |
| 9,693,639 | B2 * | 7/2017 | Corso | A47D 9/02 |
| 9,868,071 | B2 * | 1/2018 | Gilbert | H02P 25/032 |
| 11,344,137 | B1 * | 5/2022 | Jaffre | A47D 1/08 |
| 11,889,930 | B1 * | 2/2024 | Bastien | A47D 13/102 |
| 2007/0096460 | A1 * | 5/2007 | Lan | A47C 3/023 285/222 |

(Continued)

FOREIGN PATENT DOCUMENTS

| | | | | |
|---|---|---|---|---|
| CN | 2318919 | | 5/1999 | |
| CN | 203314544 | U * | 12/2013 | A47D 13/107 |

(Continued)

OTHER PUBLICATIONS

International Search Report and Written Opinion for PCT/US2023/013892, mailed Jun. 15, 2023. (pp. 13).

*Primary Examiner* — Timothy J Brindley
(74) *Attorney, Agent, or Firm* — Robert Z. Evora, Esq.

(57) ABSTRACT

A multi function bouncer and rocker is disclosed which allows for easy conversion between the different modes. Height adjustment allows for a back portion of the bouncer to lie against the frame or be positioned at varying heights. A sensor attached to a bouncer motor senses the types of movement and sends the detection signal to a controller which then changes magnetic power to the bouncer motor to allow the movement to become rhythmic.

19 Claims, 21 Drawing Sheets

(56) References Cited

U.S. PATENT DOCUMENTS

| | | | | |
|---|---|---|---|---|
| 2009/0165209 | A1* | 7/2009 | Bergkvist | A47D 13/107 5/655 |
| 2009/0284051 | A1* | 11/2009 | Zeng | A47D 13/107 297/131 |
| 2015/0082539 | A1* | 3/2015 | Lin | A47D 11/005 5/101 |
| 2015/0342368 | A1* | 12/2015 | Corso | A47D 9/053 297/354.12 |
| 2016/0037942 | A1* | 2/2016 | Guozhu | A47D 13/107 297/274 |
| 2018/0070740 | A1* | 3/2018 | Pomeroy | A47D 9/02 |

FOREIGN PATENT DOCUMENTS

| | | | | |
|---|---|---|---|---|
| CN | 204048917 | | 12/2014 | |
| CN | 113243704 A | * | 8/2021 | A47D 13/105 |

* cited by examiner

COMBINATION INFANT BOUNCER AND ROCKER

This patent application claims priority to U.S. Provisional Patent Application Ser. No. 63/313,671, filed Feb. 24, 2022, the content of which is hereby incorporated by reference herein in its entirety into this disclosure.

TECHNICAL FIELD

The subject disclosure relates generally to a bouncer for infants and small children. More particularly, the present disclosure relates to an automated baby rocker bouncer that is convertible between a bouncing configuration and a rocking configuration.

BACKGROUND

It is universally understood that infants and small children will have frequent emotional outbursts, often resulting in crying and screaming. Various tools and gadgets are available to parents and caretakers to soothe or calm an infant or small child. One common tool is a bouncer, which serves to bounce an infant in a relatively quick and repetitive up and down motion. Bouncers are very effective in soothing an upset infant, but tends to provide rapid movement, which may not be what an infant needs at a particular moment. Another common tool is a rocker, which serves to rock an infant back and forth in a rhythmic fashion, similar to a rocking chair, which serves to calm and soothe the infant. Nevertheless, a rocker may not be as effective as a bouncer in soothing a very upsent infant, but may be more helpful in encouraging a tired infant to fall sleep. Although bouncers and rockers are both very helpful in helping caretakers soothe an infant, one or the other is usually needed in a particular moment, depending on the immediate mood of the infant. Further, each of these tools is costly and requires a relatively large footprint, and it may not be feasible to have both tools available to a parent because of the requirement for a large space.

SUMMARY

The present subject disclosure describes a combination bouncer and rocker which can be converted easily between one mode to another mode. The convertible combination device allows parents and caretakers to choose the particular mode of soothing which would be best for an infant at a particular moment, without sacrificing space. Since a single device allows both modes, a parent or caretaker benefits from the advantage of having multiple tools at her disposal, without sacrificing cost and space in having both.

In one exemplary embodiment, the present subject disclosure is a combination bouncer and rocker device. The combination bouncer and rocker device includes a base having a bottom surface that contacts a floor; a pivoting leg attached to the base; a frame attached to the base; a bouncer motor attached to the frame; and an adjustment fitting for moving the frame relative to the base; wherein the pivoting leg is adapted to pivot between a bouncing configuration and a rocking configuration.

In another exemplary embodiment, the present subject disclosure is a combination bouncer and rocker device. The combination bouncer and rocker device includes a U shaped base having a bottom surface that contacts a floor; a pair of pivoting legs, each leg attached to an end of the base and including a gripping surface, wherein the pivoting legs are adapted to pivot between a bouncing configuration and a rocking configuration; a frame attached to the base; a bouncer motor attached to the frame; an adjustment fitting for moving the frame relative to the base; wherein in the bouncing configuration, the gripping surfaces of the legs face the same direction as the bottom surface of the U-shaped base; and wherein in the rocking configuration, the gripping surfaces of the legs are perpendicular to the bottom surface of the U-shaped base.

In yet another exemplary embodiment, the present subject disclosure is a combination bouncer and rocker device. The combination bouncer and rocker device includes a U shaped base having a bottom surface that contacts a floor; a pair of pivoting legs, each leg attached to an end of the base and including a gripping surface, wherein the pivoting legs are adapted to pivot between a bouncing configuration and a rocking configuration; a frame attached to the base; a magnetic bouncer motor attached to the frame; an adjustment fitting for moving the frame relative to the base; and a sensor connected to the motor which detects movement of the frame and determines whether the movement is bouncing or rocking, and provides detection information to a control unit which changes magnetic power to allow the bouncing or rocking movement to become rhythmic.

BRIEF DESCRIPTION OF THE DRAWINGS

Various exemplary embodiments of this disclosure will be described in detail, wherein like reference numerals refer to identical or similar components or steps. The accompanying drawings, which are incorporated in and constitute a part of this specification, illustrate embodiments of the subject disclosure and technical data supporting those embodiments, and together with the written description, serve to explain certain principles of the subject disclosure. With reference to the following figures, wherein.

DETAILED DESCRIPTION

The following detailed description references specific embodiments of the subject disclosure and accompanying figures, including the respective best modes for carrying out each embodiment. It shall be understood that these illustrations are by way of example and not by way of limitation.

Particular embodiments of an infant or baby combination bouncer and rocker will now be described in greater detail with reference to the figures.

Figure 1A:
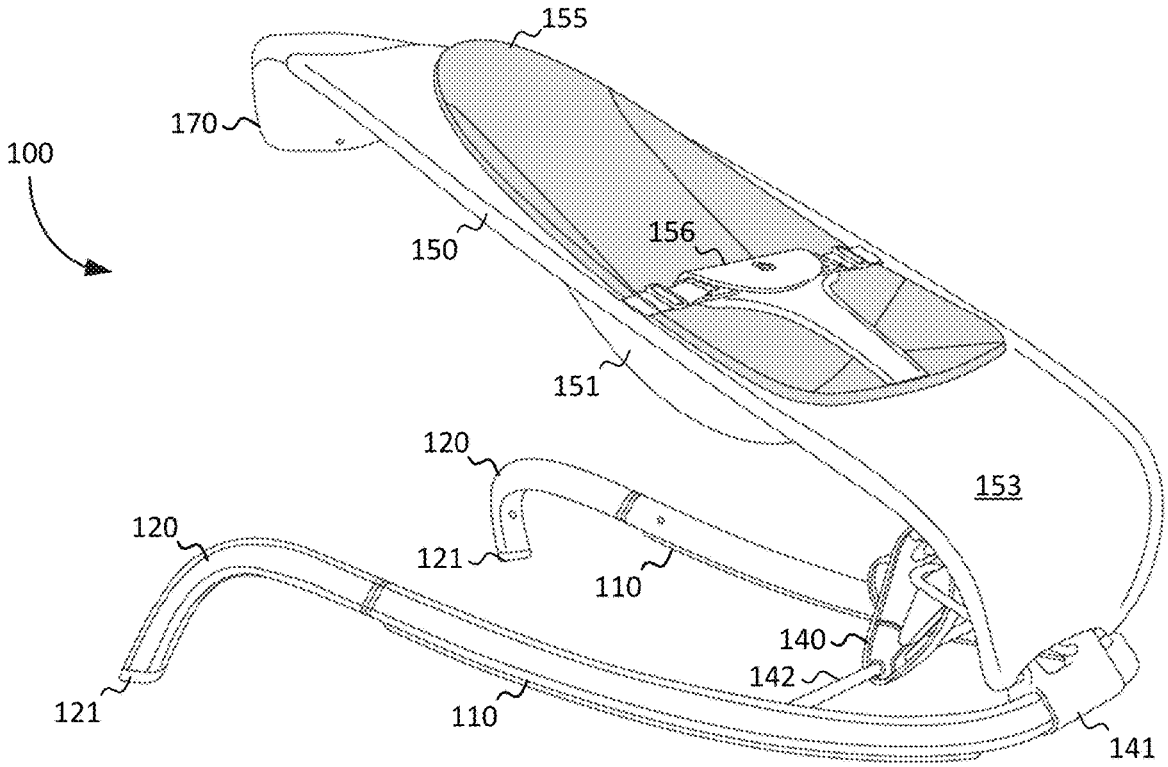
FIG. 1A is a front perspective view of a combination baby bouncer in bouncer mode, according to an exemplary embodiment of the present subject disclosure.
Figure 1B:
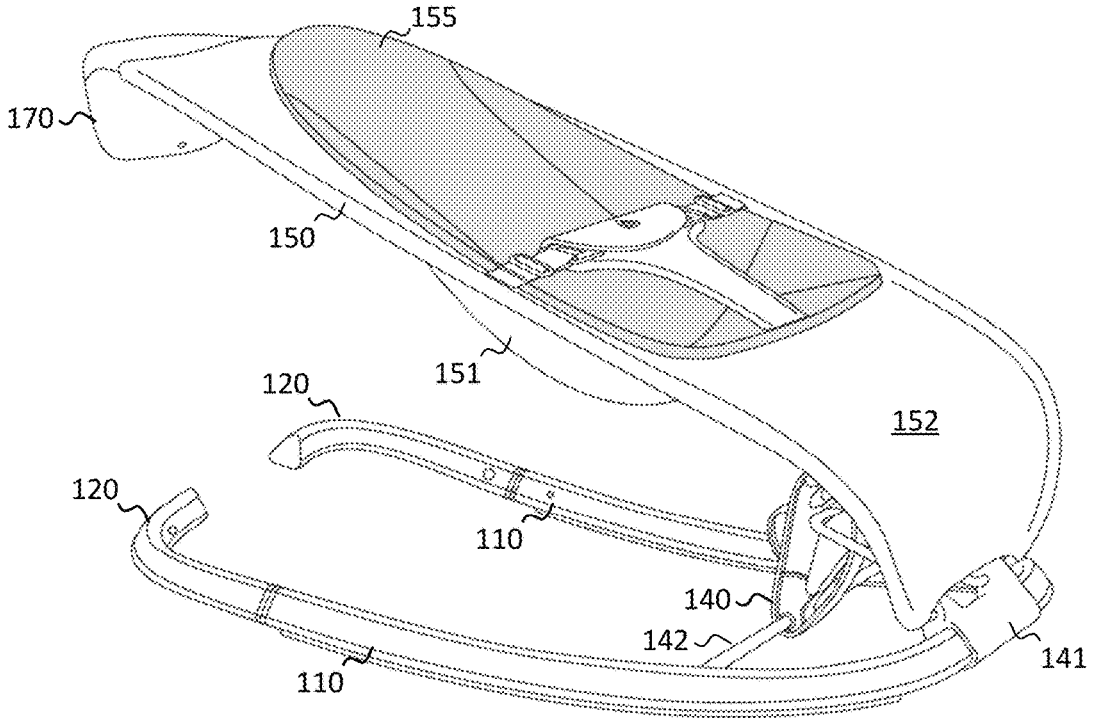
FIG. 1B is a front perspective view of a combination baby bouncer in rocker mode, according to an exemplary embodiment of the present subject disclosure.

FIGS. 1A and 1B show front perspective view of a combination baby bouncer 100 that is convertible to a baby rocker. The bouncer 100 may have a frame 150 that is attached to a U-shaped base 110. A seat cover 153 may stretch over and attach to the frame 150. The seat cover 153 may have a separate seat cushion 155 and safety harness 156 adapted to receive an infant or small child in a comfortable, safe and secure fashion. The seat cushion 155 is cradled in a molded seat portion 151. The U shaped base 110 is connected at its ends to a pair of pivotable legs 120 which may be adapted to switch between at least two different use configurations. A bouncing configuration (FIG. 1A) allows the base 110 to remain static while the frame 150 bounces. A rocking configuration (FIG. 1B) causes the base 110 to rock while the frame 150 moves in a gentle and soothing back and forth motion. An adjustment fitting 140 allows the frame 150 to be adjusted vertically, as will be discussed in further detail below. The baby bouncer 100 may be automated and may include a bouncer motor disposed in a housing 170 attached to the frame 150 that imparts a bouncing or rocking motion to the baby bouncer 100.

Figure 2:
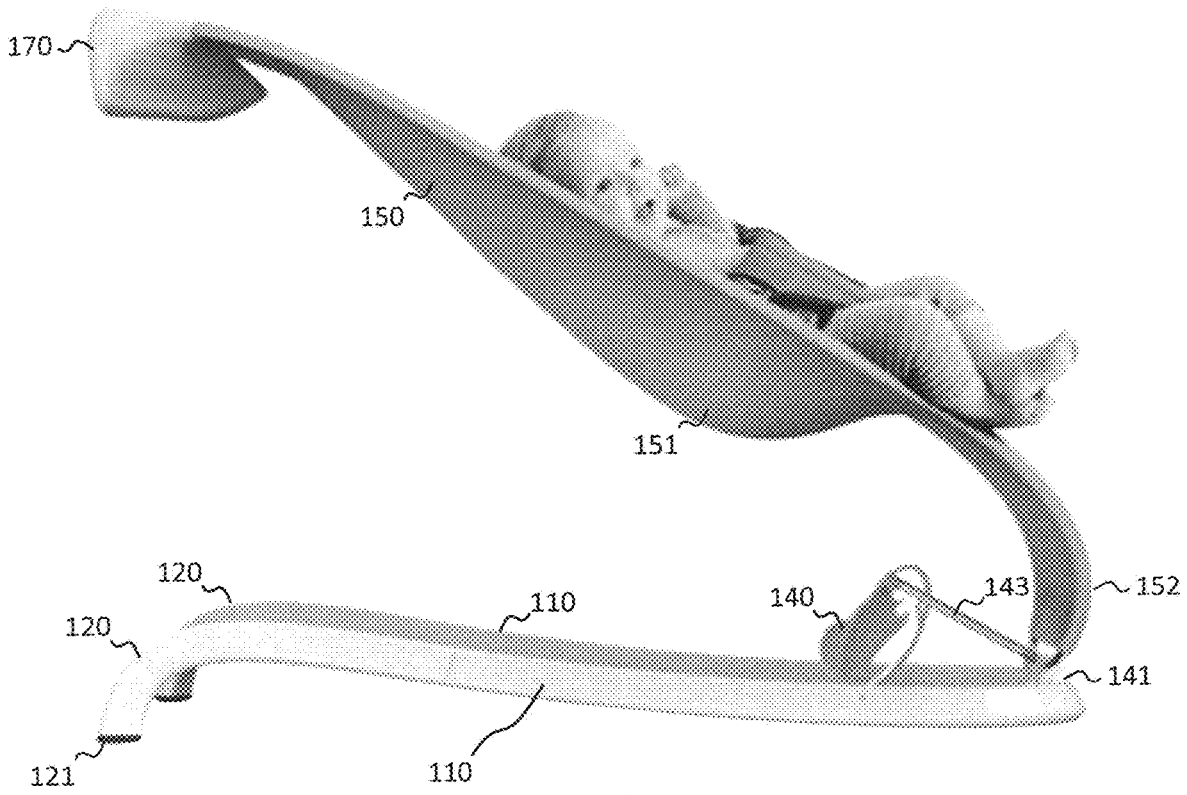
FIG. 2 is a side view of a combination baby bouncer in bouncer mode, according to an exemplary embodiment of the present subject disclosure.

FIG. 2 shows a side view of the combination bouncer 100. From this perspective, the frame 150 is shown to have a curved front end 152 that is attached via a frame linkage 141 to a front end of the base 110, away from the adjustable and pivotable legs 120. Adjustment fitting 140 allows the frame 150 to be lifted and lowered as desired. The bottom side of the frame 110 and adjustable leg 120 on each side is shown having a curved shape, resembling that of the bottom portion of a rocking chair. In this bouncing configuration, the leg grips 121 of the legs 120 are positioned on a surface, such as a floor. The frame 150 bounces to entertain and soothe the child resting on the seat 151.

Figure 3:
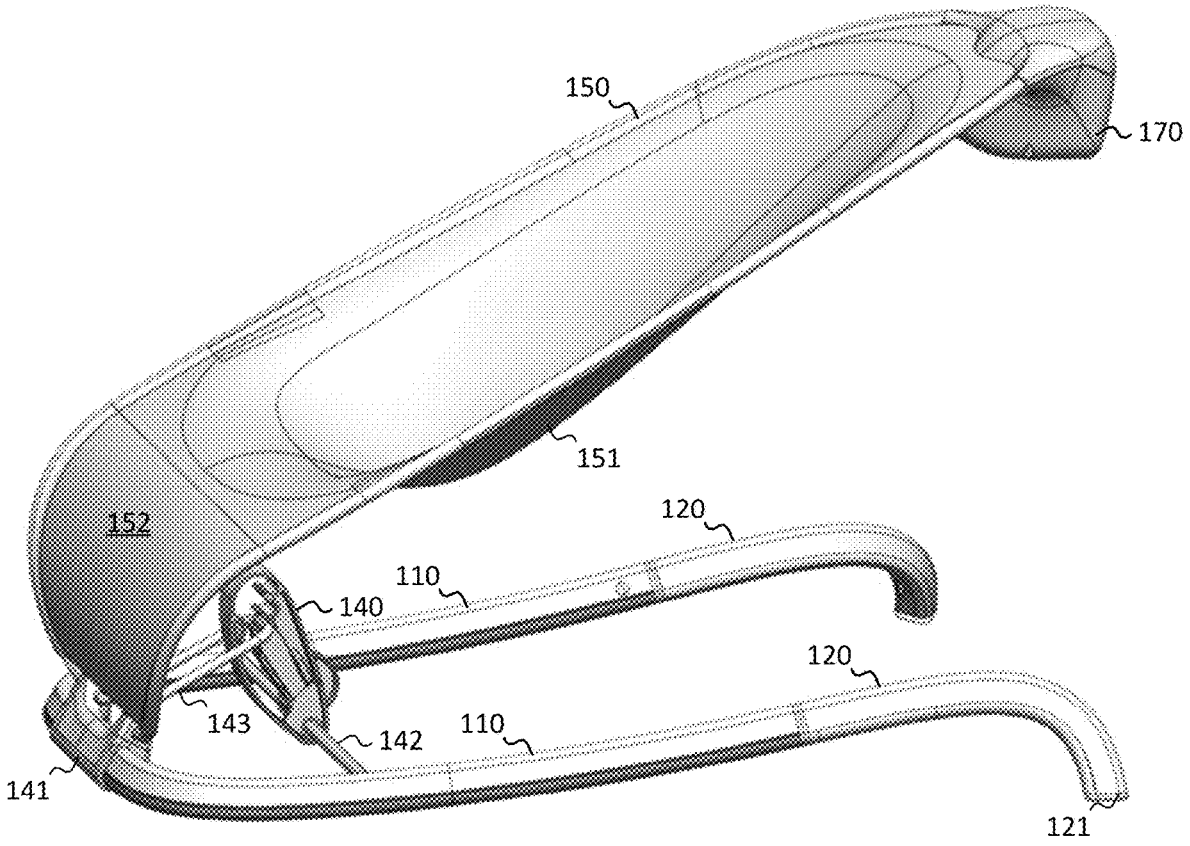
FIG. 3 is another front perspective view of a combination baby bouncer in bouncer mode, according to an exemplary embodiment of the present subject disclosure.
Figure 4:
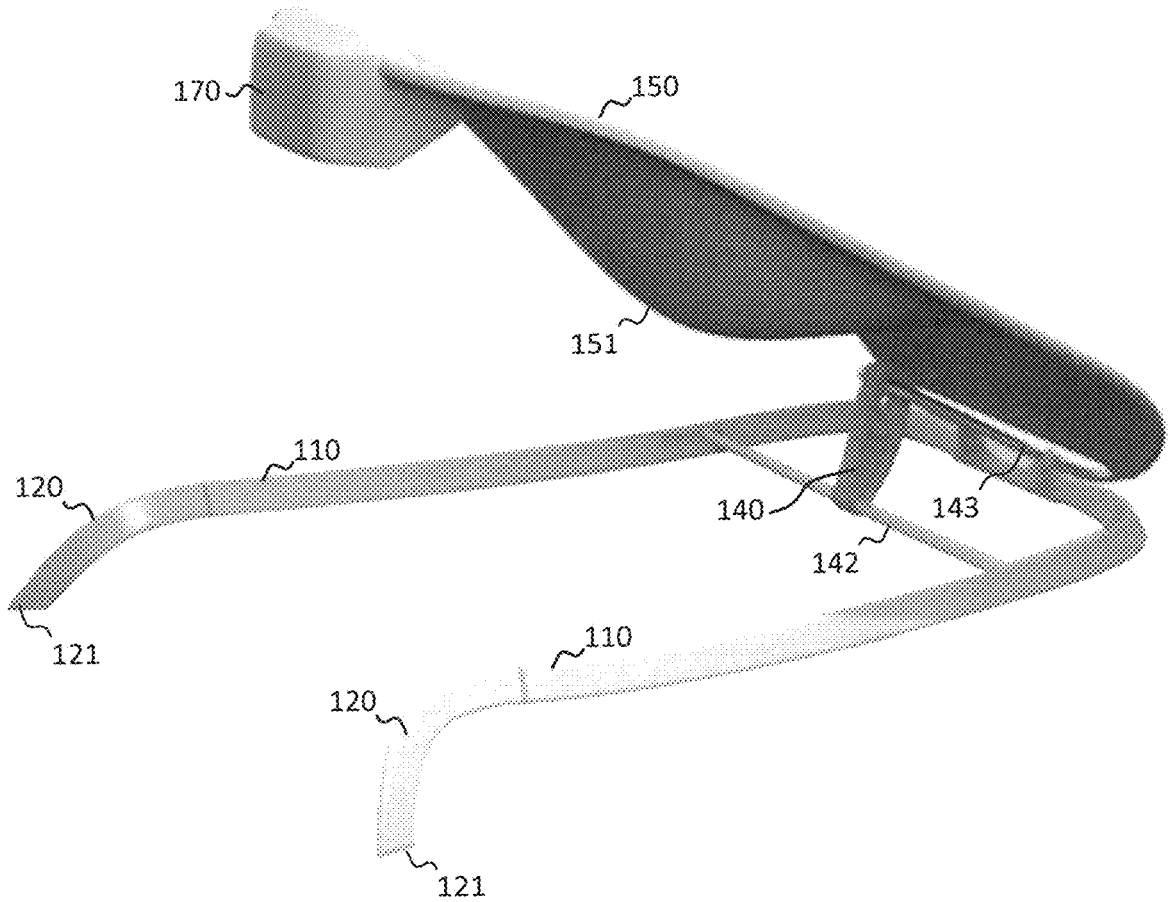
FIG. 4 is a back perspective view of a combination baby bouncer in bouncer mode, according to an exemplary embodiment of the present subject disclosure.

FIGS. 3-4 show front perspective and back perspective views of a convertible bouncer 100, respectively. In this figure, a cross bar 142 attached to the U shaped frame 110 is shown attached to a bottom portion of adjustment fitting 140. Further, a U shaped bar 143 extends from the frame linkage 141 and attaches to a top portion of adjustment fitting 140. Thus, the adjustment fitting 140 is connected to the frame 110 at both the top portion and the bottom portion.

Figure 5A:
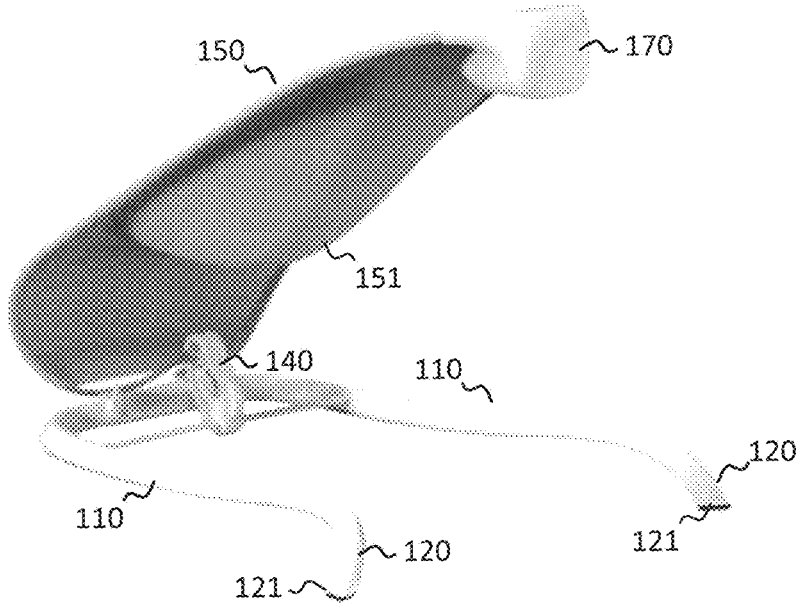
FIG. 5A is another back perspective view of a combination baby bouncer in bouncer mode, according to an exemplary embodiment of the present subject disclosure.
Figure 5B:
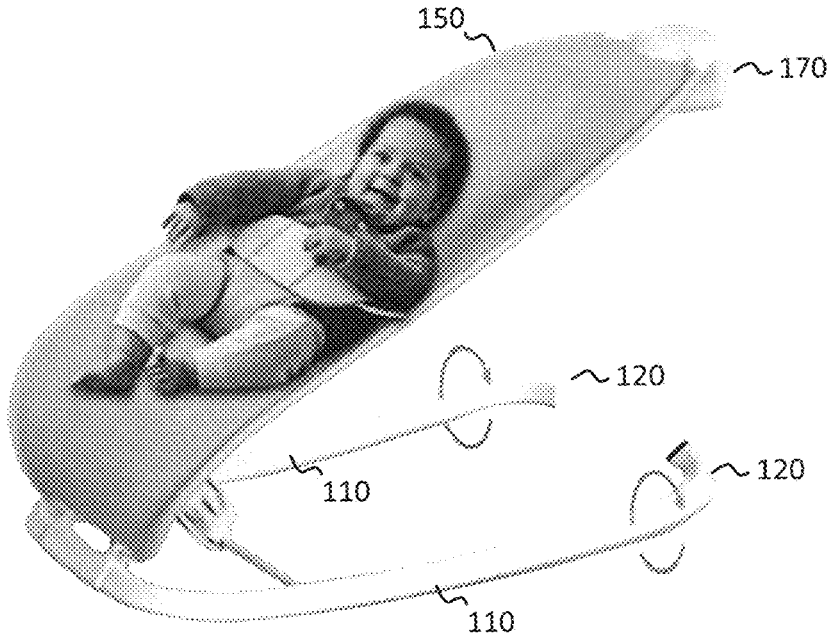
FIG. 5B is a front perspective view of a combination baby bouncer in rocker mode, according to an exemplary embodiment of the present subject disclosure.

As shown in FIGS. 5A-5B, the baby bouncer 100 may be adapted for multiple use positions. The frame 150 may be hollow, modular and may be adjusted to hold an infant at several different inclinations. FIG. 5A shows a back perspective view of the bouncer 100 in a bouncing configuration with legs grips 121 positioned on a floor surface. FIG. 5B shows an inward rotation of the legs 120 such that the leg grips 121 are positioned facing each other and no longer in contact with the floor surface. This position is the rocker position of the bouncer 100.

FIG. 5A shows the base 110 in the bouncing configuration. Pivot legs 120 are disposed at the distal end portions of the base 110 that are rotatable and may be rotated to adopt the rocking configuration shown in FIG. 5B. In the bouncing configuration, the pivot legs 120 are turned downward so that a leg grip 121 of the leg 120 is pressed firmly against the floor or support surface. The leg grip 121 is made of a material that resists slipping so that it can firmly grip the floor. This supports the base 110 in a static position so that the frame 150 may bounce up and down without causing the base 110 to travel back and forth or side to side. When the pivot legs 120 are turned up in the rocking configuration shown in FIG. 5B, a back arch of the pivot leg 120 is in contact with the ground and the entire bottom of the base 110 shares a single smooth curve. The back arch has a curved structure that allows the base 110 to rock back and forth along the back arch and the rest of the smooth curve of the bottom of the base 110. This rocking motion, like that of a boat or rocking chair, causes the frame 150 to rock back and forth and slightly up and down to soothe the infant.

As shown in FIGS. 5A, 5B, 6, 7A, 7B, 8A, 8B, and 8C, the base 110 of the baby bouncer 100 may be adapted to easily convert between at least two different bouncing configurations. The base 110 may be substantially U-shaped with a left leg and a right leg extending along a first axis and a middle saddle region that is proximate to the frame linkage 141 and has a negative curvature facing the distal ends of the left and right legs 120. That is, the base 110 has concave curvature facing the distal end of the base 110 and convex curvature facing the front 152 of the baby bouncer 110.

Figure 6:
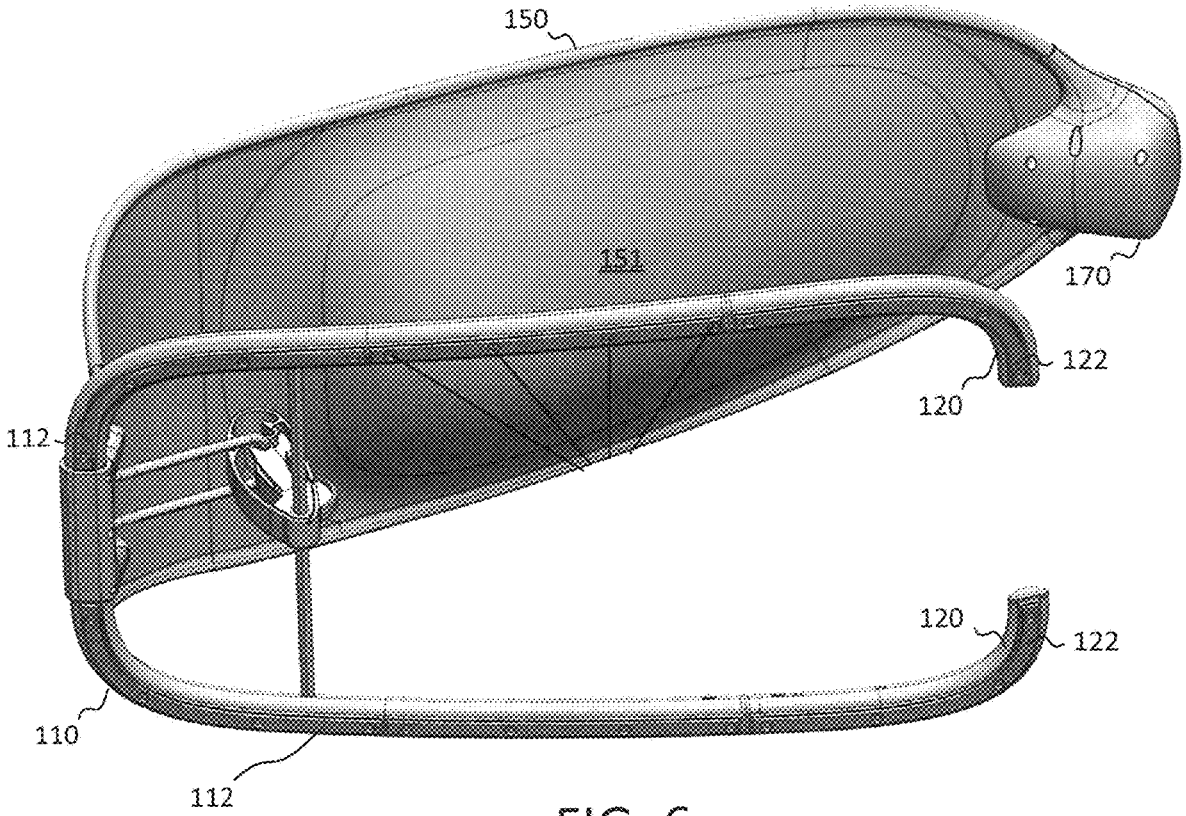
FIG. 6 is a bottom perspective view of a combination baby bouncer in rocker mode, according to an exemplary embodiment of the present subject disclosure.
Figure 7A:
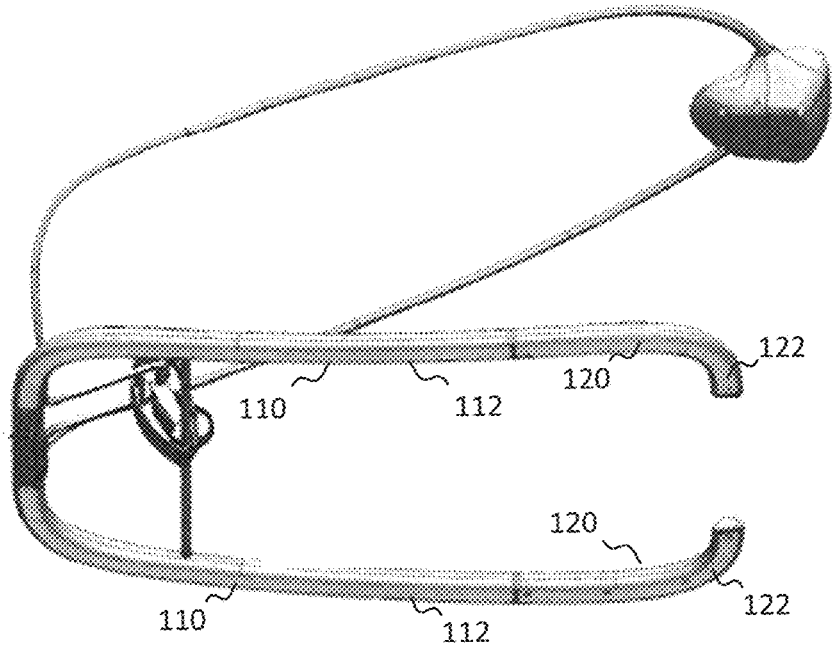
FIG. 7A is a bottom perspective view of a frame of combination baby bouncer in rocker mode, according to an exemplary embodiment of the present subject disclosure.
Figure 7B:
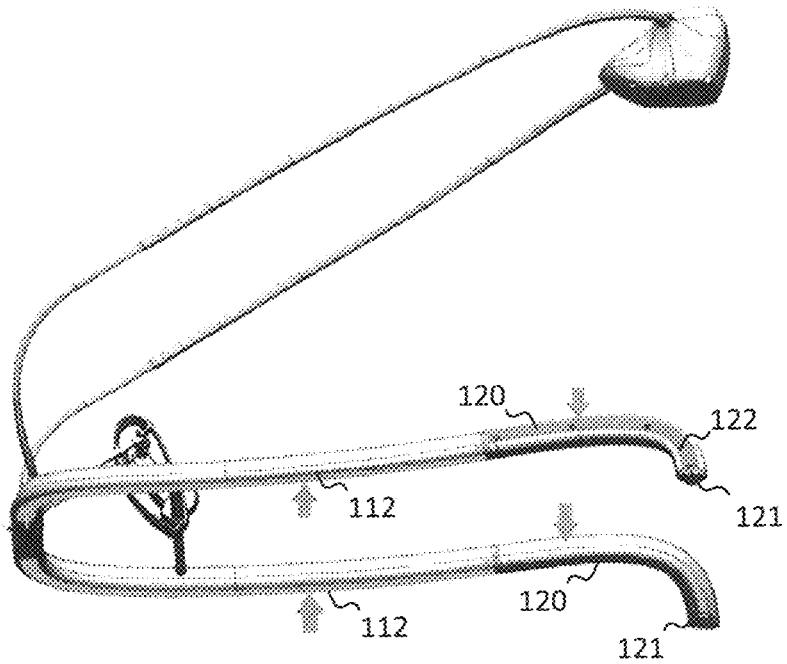
FIG. 7B is a bottom perspective view of a frame of combination baby bouncer in bouncer mode, according to an exemplary embodiment of the present subject disclosure.

FIGS. 6, 7A, and 7B show lower perspective views of the bouncer 100. In these figures, the U shaped frame 110 is shown having a layer of material 112 positioned on its underside such that the material 112 makes direct contact with a floor on which the bouncer 100 is placed. Similarly, the two legs 120 have a layer of material 122 positioned on their underside which also contact the floor. The materials 112, 122 may have gripping properties so that they stably grip the floor and prevent slipping while the bouncer 100 is in a rocking motion. They may be composed or rubber, plastic, or some similar materials or combinations thereof.

FIGS. 7A and 7B show the position of the gripping material 112, 122 when in the rocking position (FIG. 7A), and the bouncing position (FIG. 7B). The rocking position (FIG. 7A) has all materials 112, 122 covering the underside of the frame 110, and legs 120. This is necessary because when the bouncer 100 is in the rocking position, the entire underside of the frame 110 and legs 120 contact a floor surface. So the material 112, 122 provides a soft cushion contact that smooths out the motion of the bouncer 100 during a rocking motion, and also prevents slipping and damage to the floor.

When the legs 120 are moved to face each other to set up the bouncer 100 in a bouncing configuration, as shown in FIG. 7B, the underside material 112 on the frame 110 remains in the same position since the frame 110 does not change its position. However, the underside material 122 on the bottom side of pivoting legs 120 are moved outwards so that the leg grip 121 of the legs are in position to contact the floor. As shown in FIG. 7B, the material 122 is then positioned on the outer side of the legs 120 when the bouncer 100 is in the bouncing configuration.

Figure 8A:
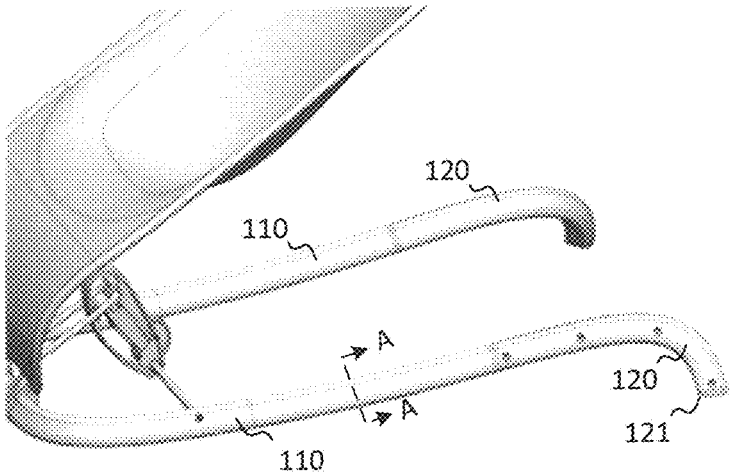
FIG. 8A is a bottom perspective view of a frame of combination baby bouncer in bouncer mode, according to an exemplary embodiment of the present subject disclosure.
Figure 8B:
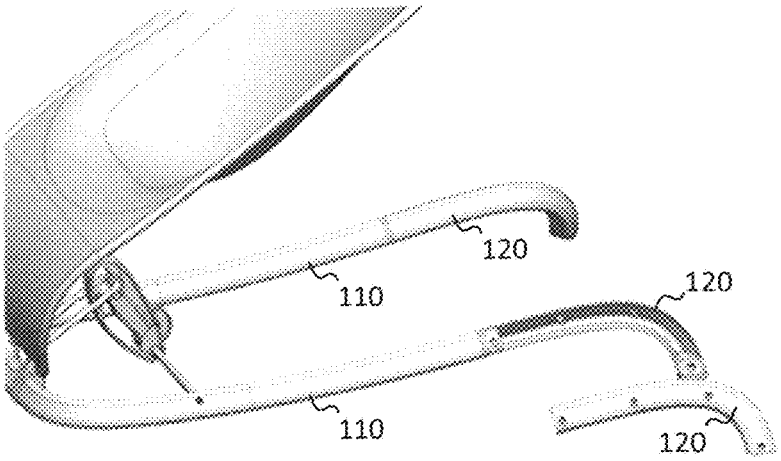
FIG. 8B is a bottom perspective view of a frame of combination baby bouncer in bouncer mode with pivot leg partially removed, according to an exemplary embodiment of the present subject disclosure.

FIGS. 8A and 8B show perspective view of the base 110 and leg 120 areas of the bouncer 100 in a bouncing configuration, namely with the leg portions 120 pointing downward to allow the leg grip 121 to contact the floor. FIG. 8B shows a leg 120 with a portion removed to show the generally hollow interior thereof.

Figure 8C:
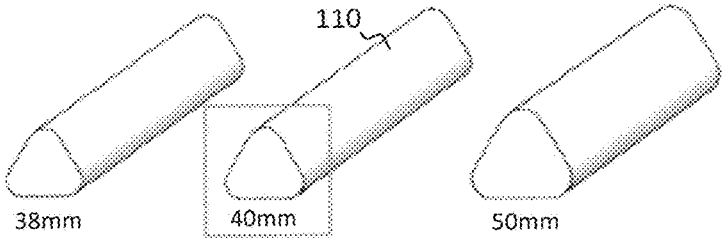
FIG. 8C is a cross sectional view along plane A-A of FIG. 8A of a frame of a combination baby bouncer, according to an exemplary embodiment of the present subject disclosure.

FIG. 8C shows a cross section of the frame 110 taken at a plane A-A in FIG. 8A, perpendicular to a longitudinal length of the frame 110. Although the cross section area is shown as triangular, it can be any shape, including circular, oval, hexagonal, etc. Further, the frame 110 size may vary, and be for example, 38 mm, 40 mm, 50 mm, or other.

FIGS. 9A, 9B, 9C, and 9D show further detail of the attachment between the base 110 and pivot leg 120 at a pivot leg attachment junction. Complementary geometry (i.e., male and female interlinking structures such as protrusions or hooks with matching apertures or recesses) between the leg attachment on the base 110 and the pivot leg 120 allow the pivot leg 120 to be easily rotated by a user. A pin that may be elastic or a screw attachment or friction fit attachment may attach through the ends of the base 110 and the pivot leg 120 to keep the leg 120 attached to the base 110 while it is being rotated by the user. The adjustment of the pivot leg 120 from the bouncing to rocking configurations may be automated and initiated by a user through a control panel input choosing either the bouncing or rocking mode.

Figure 9A:
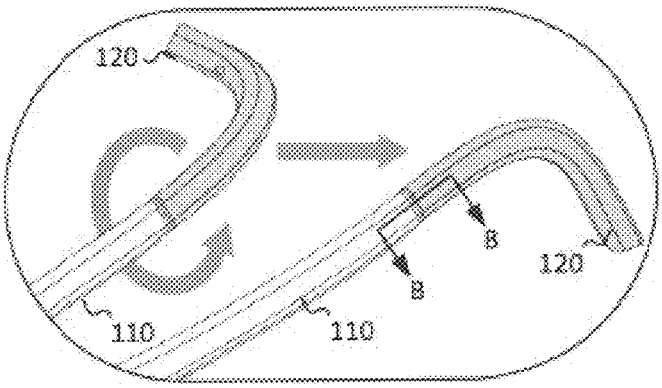
FIG. 9A is a perspective view of change of a pivot leg from rocker mode to bouncer mode, according to an exemplary embodiment of the present subject disclosure.
Figure 9B:
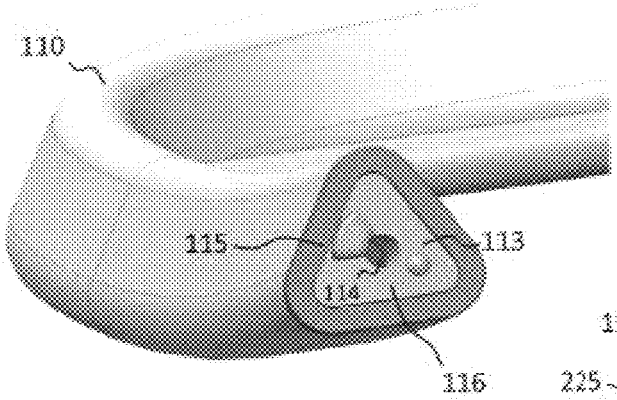
FIG. 9B is a perspective view of an end of frame where it attaches to a pivot leg, according to an exemplary embodiment of the present subject disclosure.
Figure 9C:
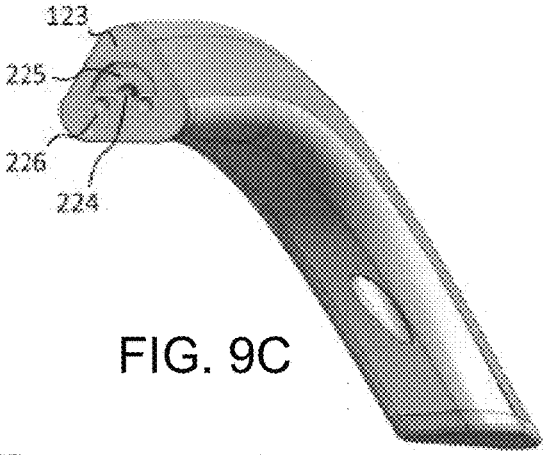
FIG. 9C is a perspective view of an end of pivot leg where it attaches to a frame, according to an exemplary embodiment of the present subject disclosure.
Figure 9D:
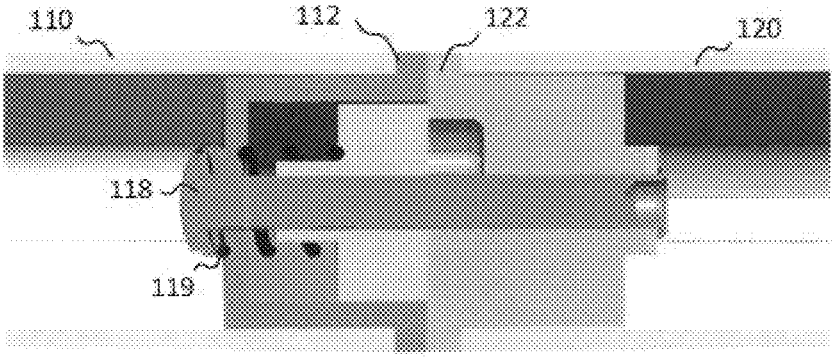
FIG. 9D is a cross sectional view along plane B-B of FIG. 9A of the connection point between a frame and a pivot leg, according to an exemplary embodiment of the present subject disclosure.

FIG. 9A shows the rotation movement of the leg 120 with respect to the frame 110 between a rocker position to a bouncer position. FIG. 9B shows the connection area of the frame 110 and FIG. 9B shows the connection area of the leg 120. FIG. 9D shows a cross sectional plane of the connection between the connection point of the frame 110 and leg 120. Complementary surface 113 on the frame 110 is adjacent to complementary surface 12 on the leg. The surfaces 113, 123 may be composed of a durable material which allows for repeated movement of the surfaces against each other without deterioration. For example, the surfaces 113, 123 may be a hard rubber, plastic or similar material. A connection rod 118 spans across aperture 114 in the frame 110 and aperture 224 in the leg 220. The rod 118 secures the two components (frame 110 and leg 120) together so that they maintain their connection even with repeated rotations. A ridge 115 on the end of the frame 110 mates with a complementary groove 225 on the end of the leg 120. The ridge 115 to groove 225 connection is maintained at all times, even with rotation of the two attaching components, frame 110 and leg 120. The ridge 115 is a quarter circle, and the groove 225 is a semi-circle. A projection 116 on the end of the frame 110 mates with one of two indentations 226. The connection of the projection 116 to indentation 226 determines the locking position of the frame 110 to leg 120. In one position (projection 116 connecting to one indentation 226), the leg 120 is in the bouncer position, and in another position (projection 116 connecting to the second indentation 226), the leg 120 is in the rocking position.

Figure 10A:
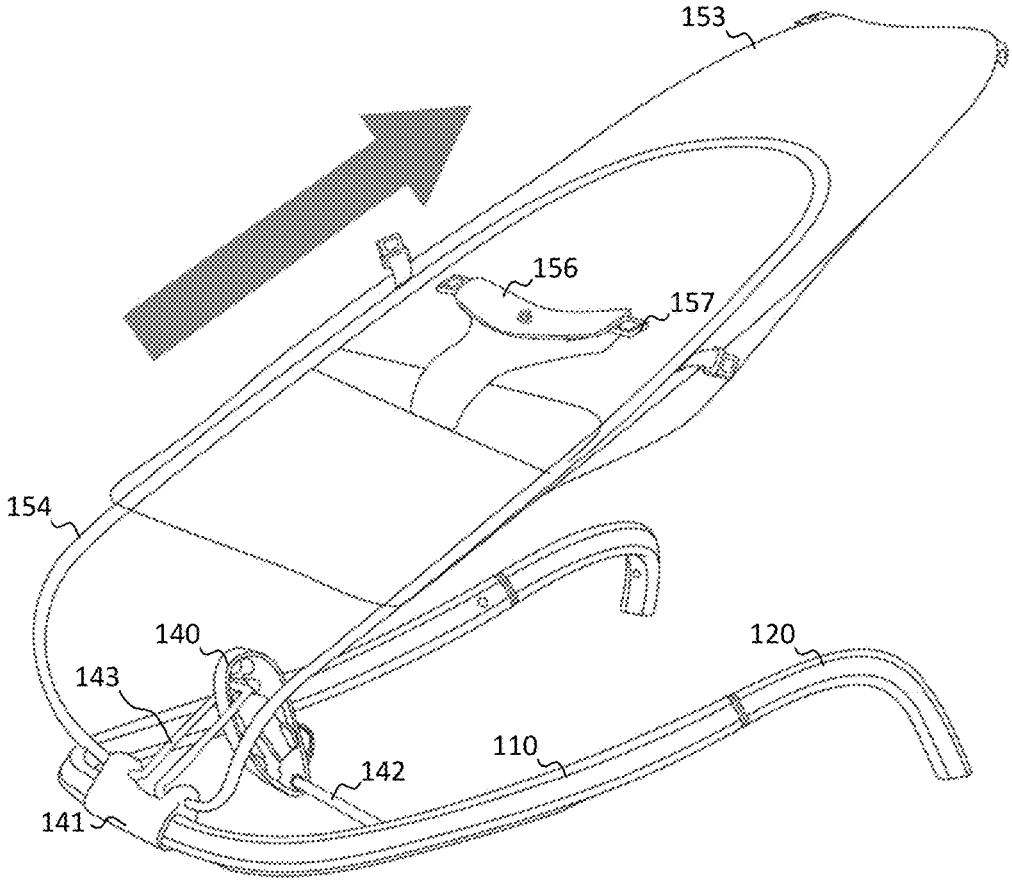
FIG. 10A is a front perspective view of combination baby bouncer with seat cover being removed, according to an exemplary embodiment of the present subject disclosure.
Figure 10B:
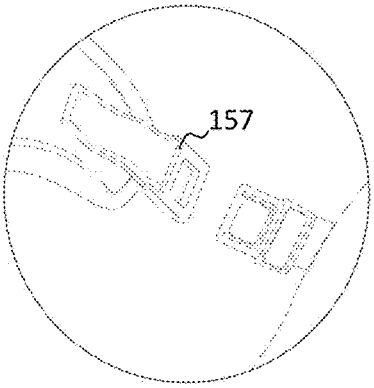
FIG. 10B is a front view of a harness belt, according to an exemplary embodiment of the present subject disclosure.
Figure 10C:
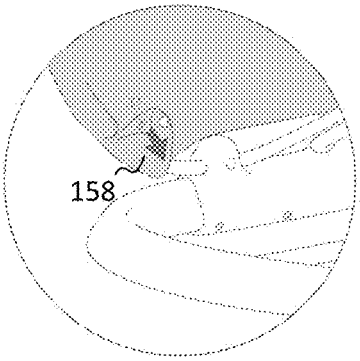
FIG. 10C is a front view of a connection flap at a bottom of the seat cover, according to an exemplary embodiment of the present subject disclosure.
Figure 10D:
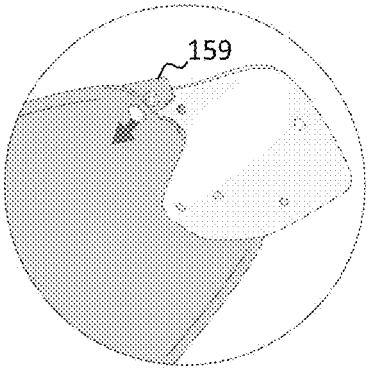
FIG. 10D is a front view of a connection flap at a top of the seat cover, according to an exemplary embodiment of the present subject disclosure.

FIG. 10A shows a front perspective view of the bouncer 100 with a top seat cover 153 being removed from the upper frame 154. FIG. 10B shows a seat belt locking mechanism 157 which is used to secure the child in the safety harness 156. FIG. 10C shows a flap 158 on the seat cover 153 which wraps around a portion of the upper frame 154. FIG. 10D shows a flap 159 with snap lock that wraps around a top portion of the upper frame 154, close to the motor housing 170. Other reversible locking mechanisms may also be used including, but not limited to, hook and loop, zipper, button, etc.

Figure 11A:
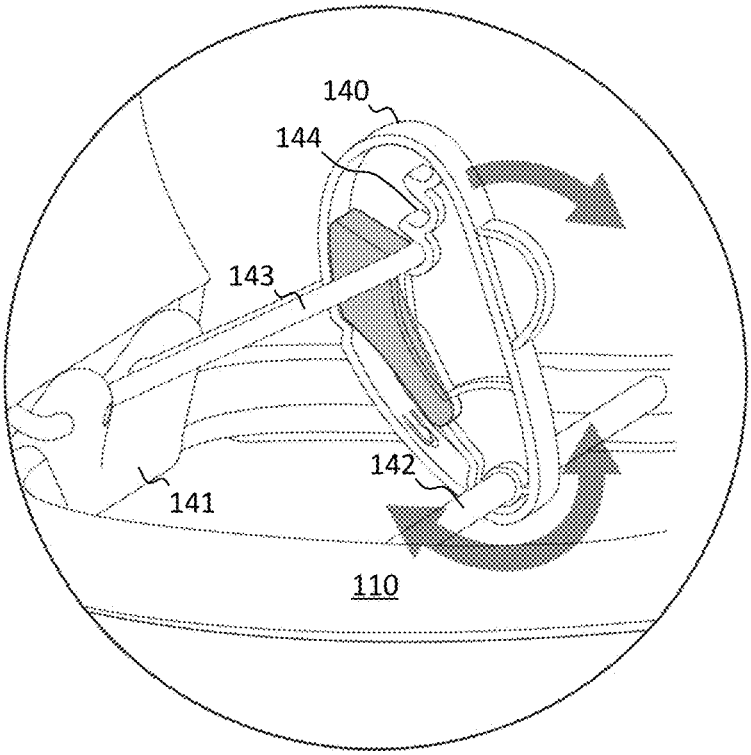
FIG. 11A is a front perspective view of an adjustment fitting in a mode where the frame is held up, according to an exemplary embodiment of the present subject disclosure.
Figure 11B:
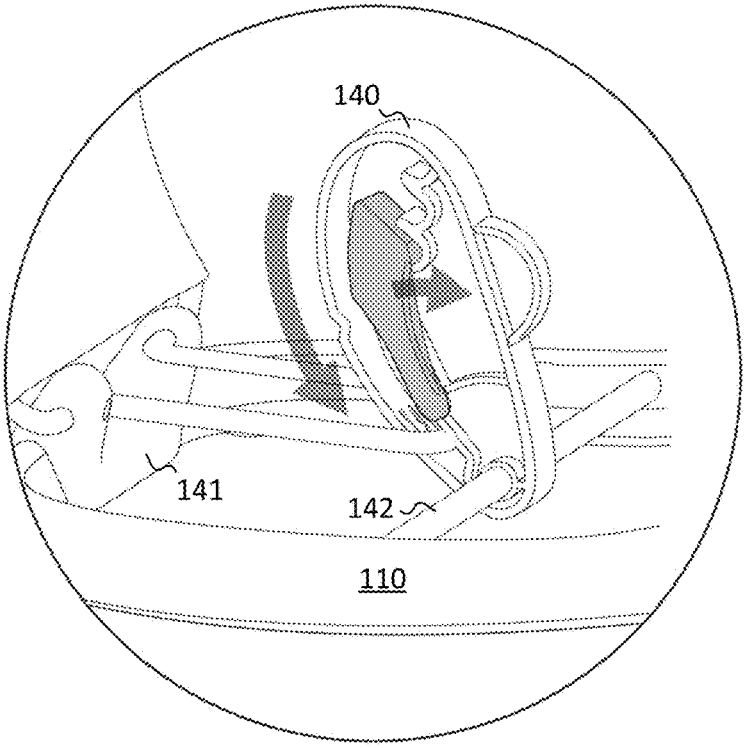
FIG. 11B is a front perspective view of an adjustment fitting in a mode where the frame is folded over the base, according to an exemplary embodiment of the present subject disclosure.

FIGS. 10A, 11A, and 11B show an adjustment fitting 140 which may include different locking steps 144 for locking the bouncer at a specific or preset inclination (e.g., upright, midway, and low). The adjustment fitting 140 may be attached to a frame linkage 141 attached to the bottom of the frame 110 through a U shaped bar 143, and directly to a base linkage 142 that is attached to the base 110. The adjustment fitting 140 allows for the one-handed adjustment of the baby bouncer 100 by a user or caregiver. The adjustment fitting 140 may be used to lay the frame 150 against the base 110 in a substantially flat position for easy travel and storage.

Figure 12A:
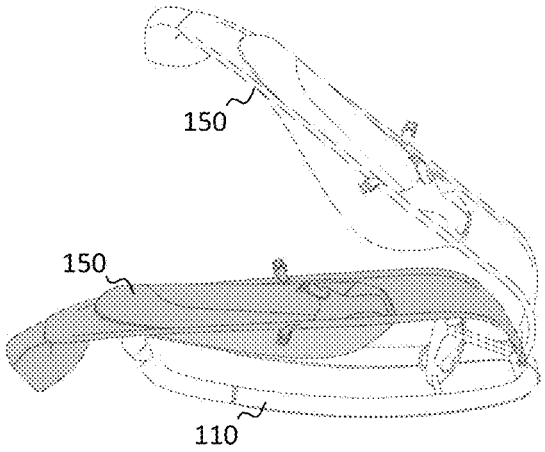
FIG. 12A is a front perspective view of a frame in resting and upward positions, according to an exemplary embodiment of the present subject disclosure.
Figure 12B:
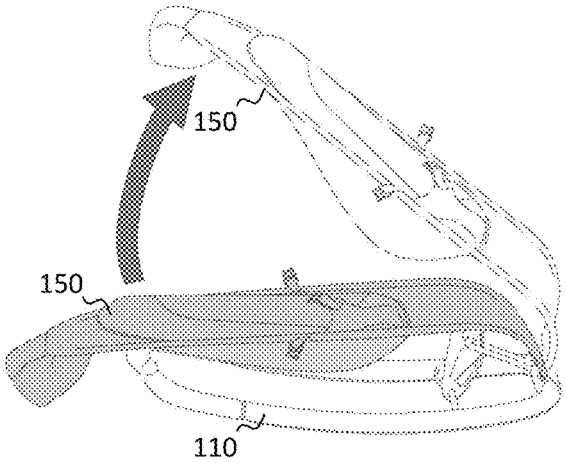
FIG. 12B is a front perspective view of a frame moving from resting to upward position, according to an exemplary embodiment of the present subject disclosure.
Figure 12C:
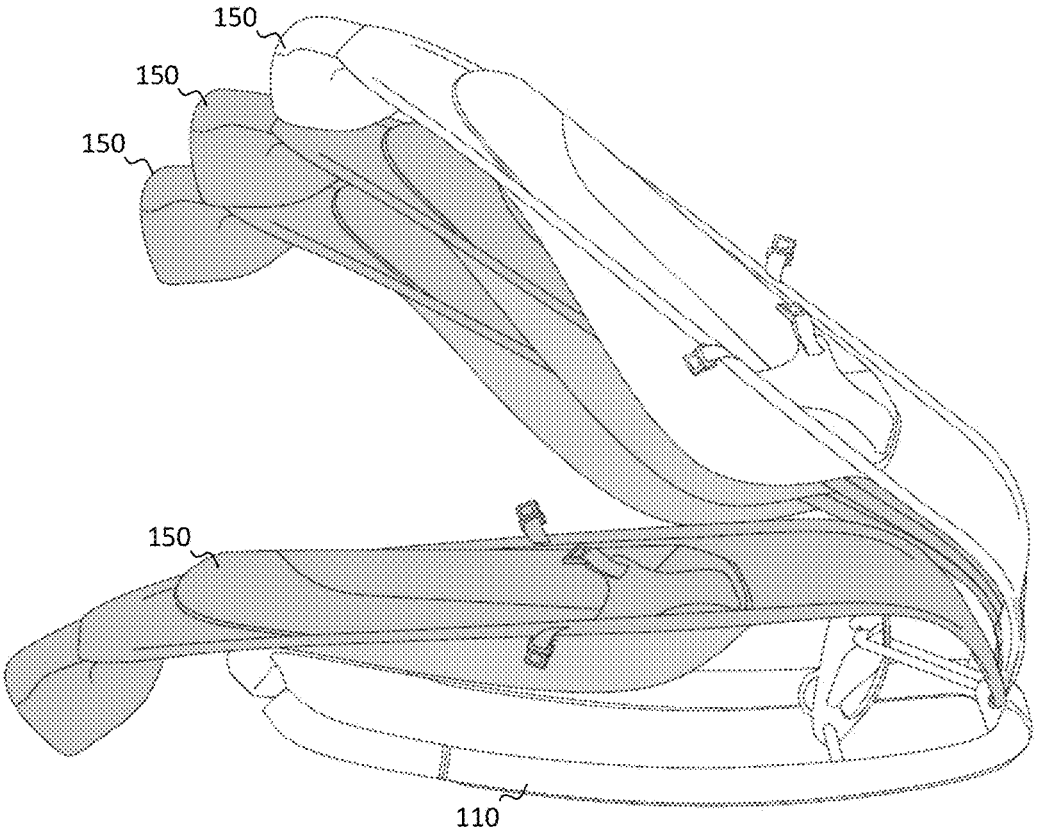
FIG. 12C is a front perspective view of a frame in four different positions, according to an exemplary embodiment of the present subject disclosure.

FIGS. 12A, 12B, and 12C show the relative position of the frame 150 with respect to the base 110, as set by the adjustment fitting 140. FIG. 12A shows the frame 150 in a flat position but with desire to move the frame into an upright position. The flat position of the frame 150 is possible by setting the U shaped bar 143 in the adjustment fitting 140 in the lowest position shown in FIG. 11B. In order to move the frame 150 upwards, the U shaped bar 143 is disengaged from the adjustment fitting 140 so that the U shaped bar 143 is locked into one of several locking steps 144, as shown in FIG. 11A. In the example shown in FIG. 12C, one flat position and three inclined positions for the frame 150 are shown, which corresponds to the 4 different positions on the locking steps 144 on the adjustment fitting 140, as shown in FIGS. 11A and 11B.

Figure 13A:
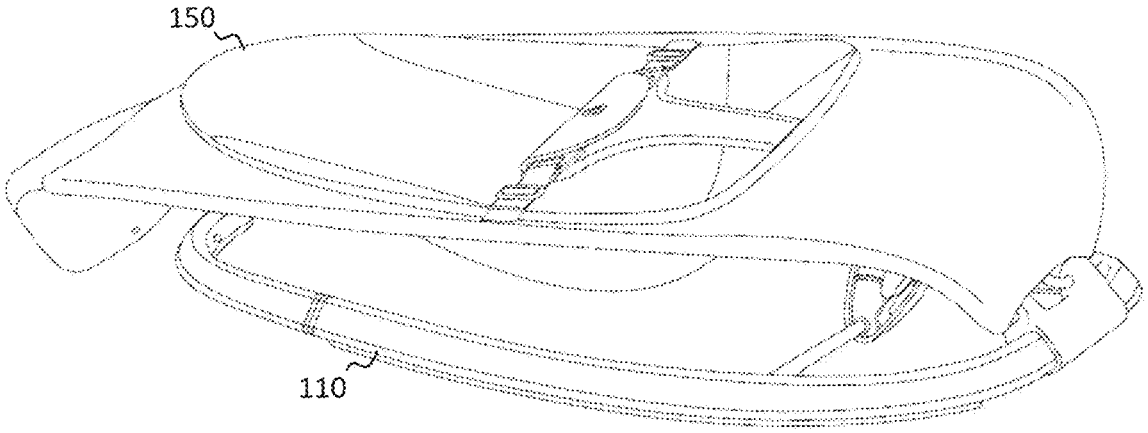
FIG. 13A is a front perspective view of a frame in resting position, according to an exemplary embodiment of the present subject disclosure.
Figure 13B:
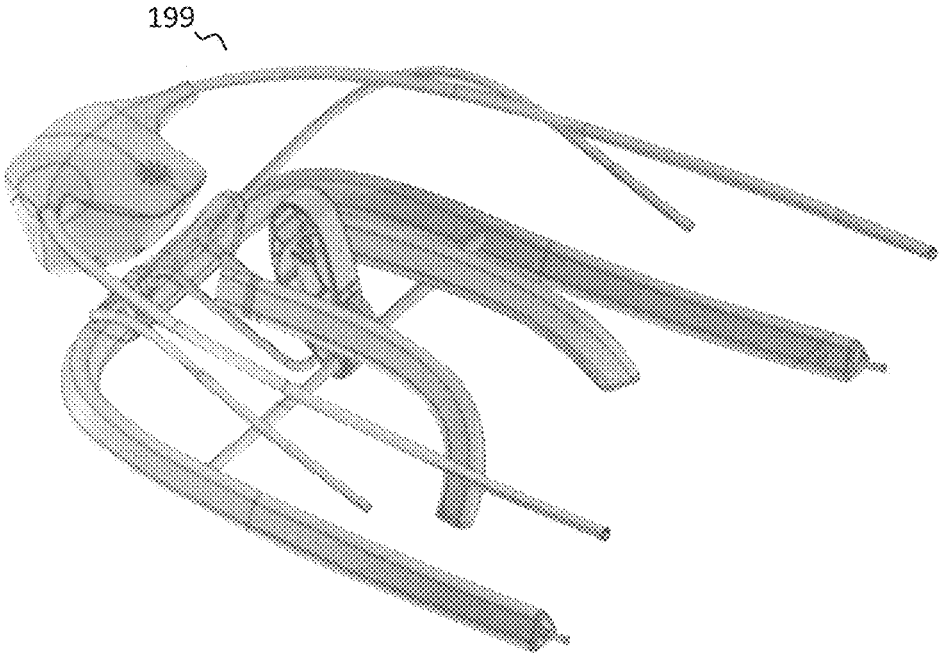
FIG. 13B is a front perspective view of a compact and packaged combination rocker and bouncer device, according to an exemplary embodiment of the present subject disclosure.

As shown in FIG. 13A, the bouncer 100 is designed to be folded flat, which is helpful not only in saving space within a user's home, but also in a container 199 during shipping and storage, as shown in FIG. 13B.

Figure 14A:
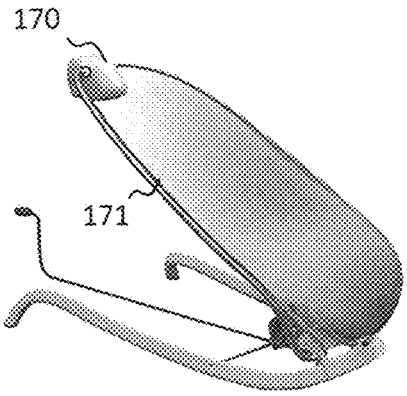
FIG. 14A is a front perspective view of a combination bouncer with a power cord in a given configuration, according to an exemplary embodiment of the present subject disclosure.
Figure 14B:
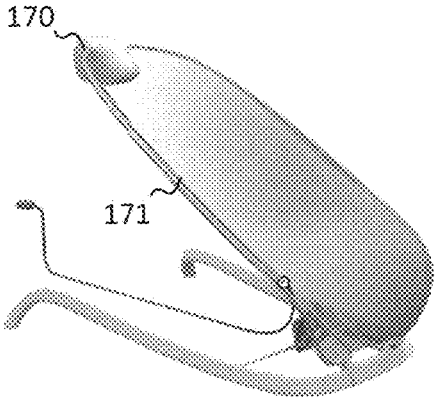
FIG. 14B is a front perspective view of a combination bouncer with a power cord in a given configuration, according to an exemplary embodiment of the present subject disclosure.
Figure 14C:
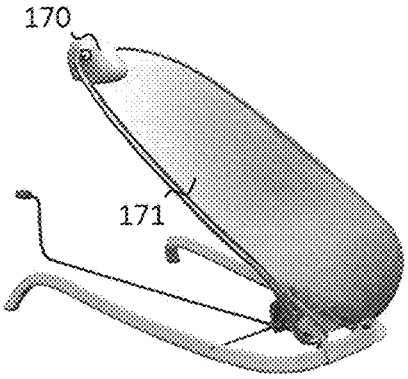
FIG. 14C is a front perspective view of a combination bouncer with a power cord in a given configuration, according to an exemplary embodiment of the present subject disclosure.
Figure 14D:
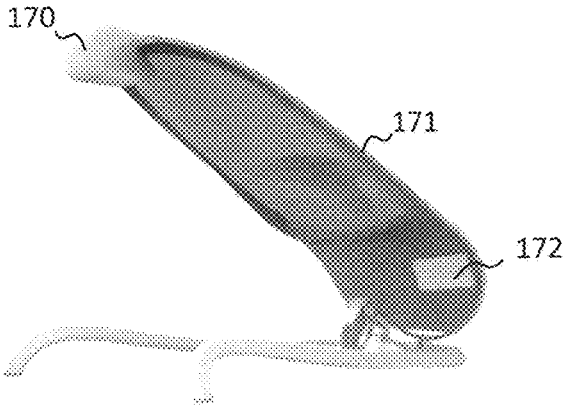
FIG. 14D is a front perspective view of a combination bouncer with a DC power source in a given position, according to an exemplary embodiment of the present subject disclosure.
Figure 14E:
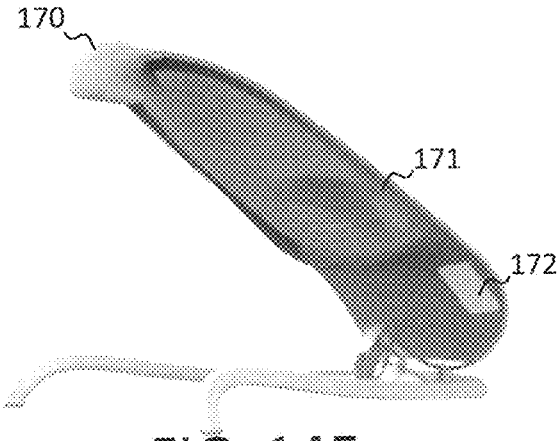
FIG. 14E is a front perspective view of a combination bouncer with a DC power source in a given position, according to an exemplary embodiment of the present subject disclosure.
Figure 15:
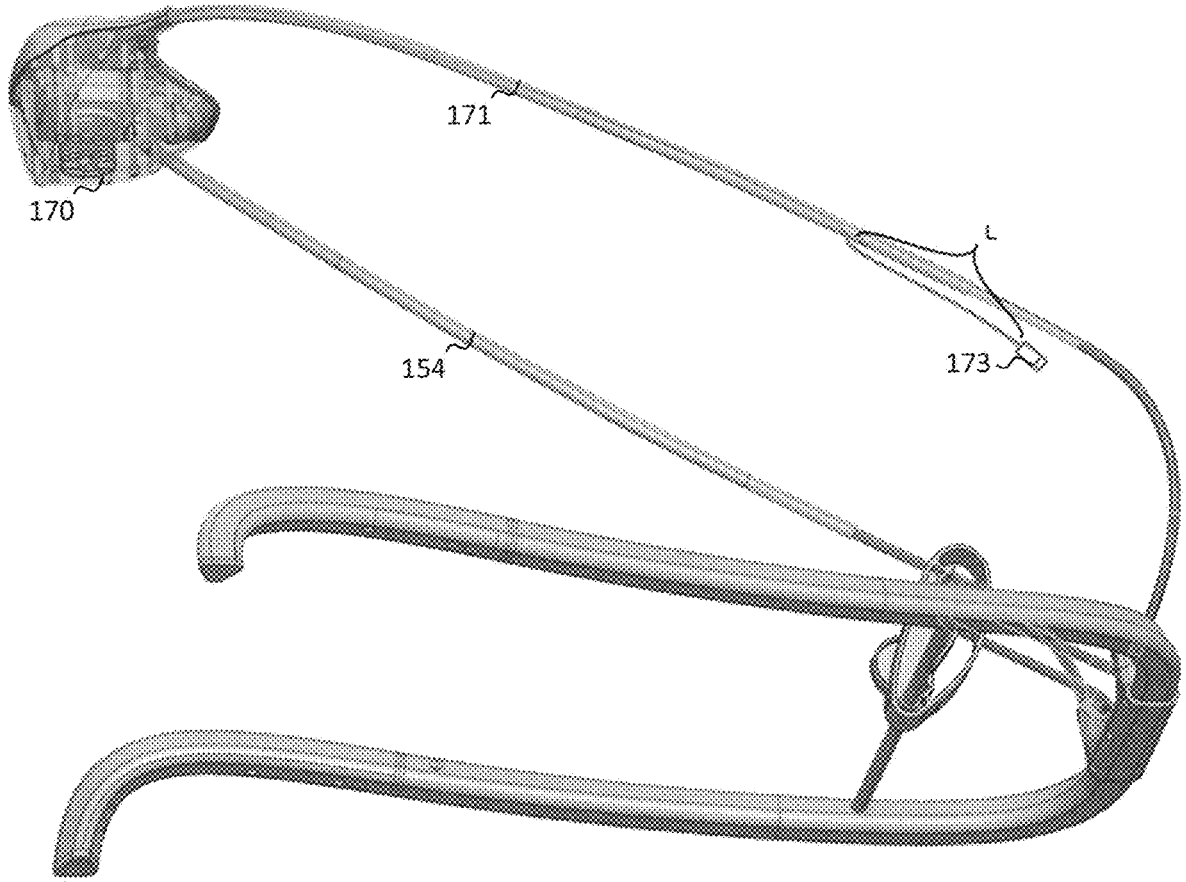
FIG. 15 is a bottom perspective view of a combination bouncer with a USB-C port cord in a given configuration, according to an exemplary embodiment of the present subject disclosure.

FIGS. 14A, 14B, 14C, 14D, 14D, and 14E show various exemplary embodiments of the connection of power source to the motor in housing 170. Cord management is especially useful for a folding baby bouncer 100 as the desire is to have the cord be subtle and away from the infant, for safety and aesthetic reasons. The examples shown in FIGS. 14, 14B, and 14C use alternating current (AC) power, and the examples shown in FIGS. 14D and 14E use direct current (DC) power. FIGS. 14A, 14B, and 14C shows a power cord connection 171 leading from the motor housing 170 along a side of the frame 150 and out the back side of the bouncer 100 to a conventional wall power plug. FIGS. 14D and 14E show a power cord 171 leading from the motor housing 170 along a side of the frame 150 to a battery power unit 172. FIG. 15 shows another example of a power cord 171 connection leading to a USB-C type connector 173, which may then be connected to a separate conventional power plug or power source (not shown) which connect to the USB power connector 173. In all these examples, the power cord connection 171 may extend from the seat cover 155 or out from within the hollow frame 154. The variations show are mere examples, and any combination may be used.

Figure 16A:
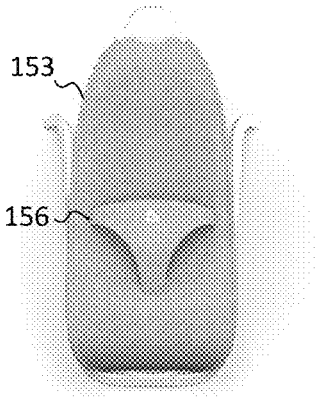
FIG. 16A is a front view of a seat cover and harness in a given configuration, according to an exemplary embodiment of the present subject disclosure.
Figure 16B:
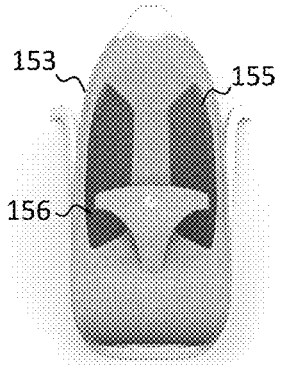
FIG. 16B is a front view of a seat cover and harness in a given configuration, according to an exemplary embodiment of the present subject disclosure.
Figure 16C:
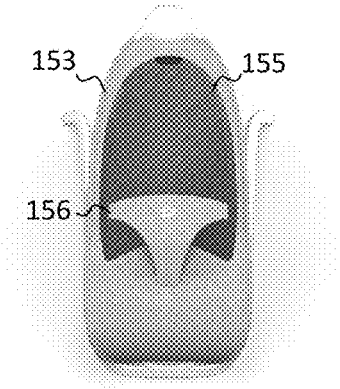
FIG. 16C is a front view of a seat cover and harness in a given configuration, according to an exemplary embodiment of the present subject disclosure.
Figure 16D:
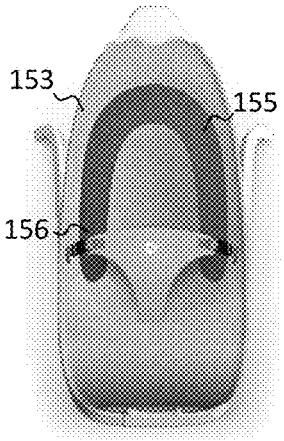
FIG. 16D is a front view of a seat cover and harness in a given configuration, according to an exemplary embodiment of the present subject disclosure.
Figure 16E:
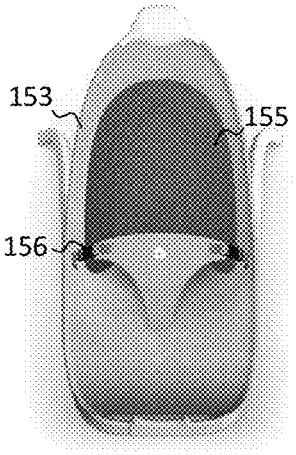
FIG. 16E is a front view of a seat cover and harness in a given configuration, according to an exemplary embodiment of the present subject disclosure.
Figure 16F:
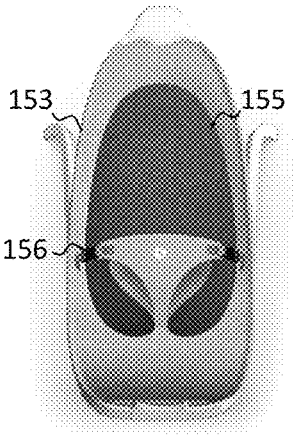
FIG. 16F is a front view of a seat cover and harness in a given configuration, according to an exemplary embodiment of the present subject disclosure.
Figure 16G:
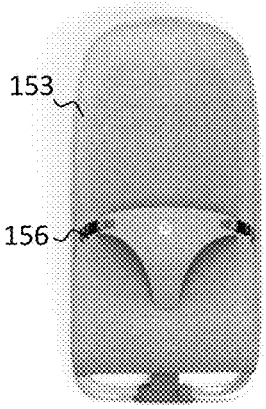
FIG. 16G is a front view of a seat cover and harness in a given configuration, according to an exemplary embodiment of the present subject disclosure.
Figure 16H:
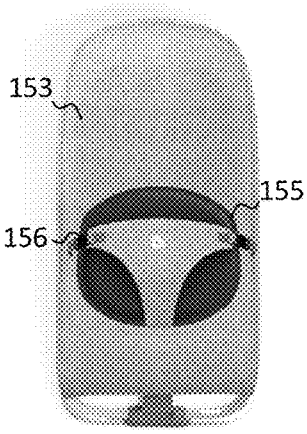
FIG. 16H is a front view of a seat cover and harness in a given configuration, according to an exemplary embodiment of the present subject disclosure.
Figure 16I:
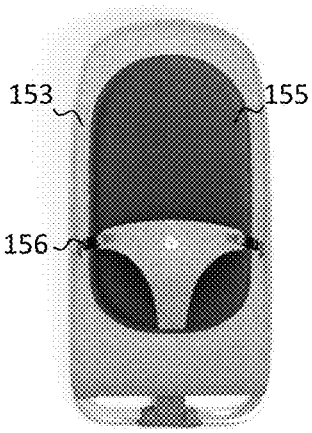
FIG. 16I is a front view of a seat cover and harness in a given configuration, according to an exemplary embodiment of the present subject disclosure.

FIGS. 16A, B, C, D, E, F, G, H, and I show different seat cover arrangements. Fabric and mesh portions of the seat cover 153 may be configured to maximize weight distribution, air flow, lumbar support, ergonomic factors, safety features and the like. The harness 156 may include fabric and mesh portions. The harness 156 may meet applicable safety standards and regulations to insure the safe and effective holding of the infant or child during the use of the baby bouncer. FIG. 16A shows a seat cover 153 and harness 156 with no separate seat cushion. FIG. 16B shows a seat cover 153 and harness 156 with a split seat cushion 155 arrangement. FIG. 16C shows a seat cover 153 and harness 156 with a full back seat cushion 155 arrangement. FIG. 16B shows a seat cover 153 and adjustable harness 156 with a rainbow seat cushion 155 arrangement. FIG. 16E shows a seat cover 153 and adjustable harness 156 with a shortened full back seat cushion 155 arrangement. FIG. 16F shows a seat cover 153 and adjustable harness 156 with an extended full back seat cushion 155 arrangement. FIG. 16G shows a seat cover 153 and adjustable harness 156 with no separate seat cushion. FIG. 16H shows a seat cover 153 and adjustable harness 156 with a bottom side only seat cushion 155 arrangement. FIG. 16I shows a seat cover 153 and adjustable harness 156 with an extended full back and bottom seat cushion 155 arrangement.

Figure 17A:
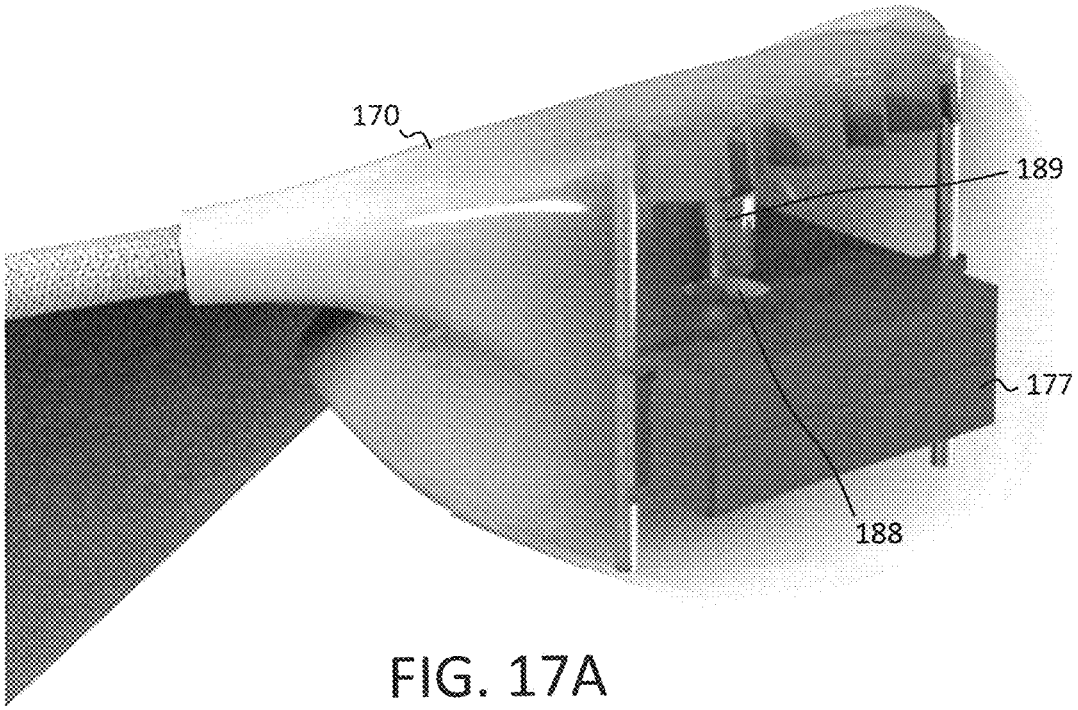
FIG. 17A is a front perspective view of a bouncer motor in a first position, according to an exemplary embodiment of the present subject disclosure.
Figure 17B:
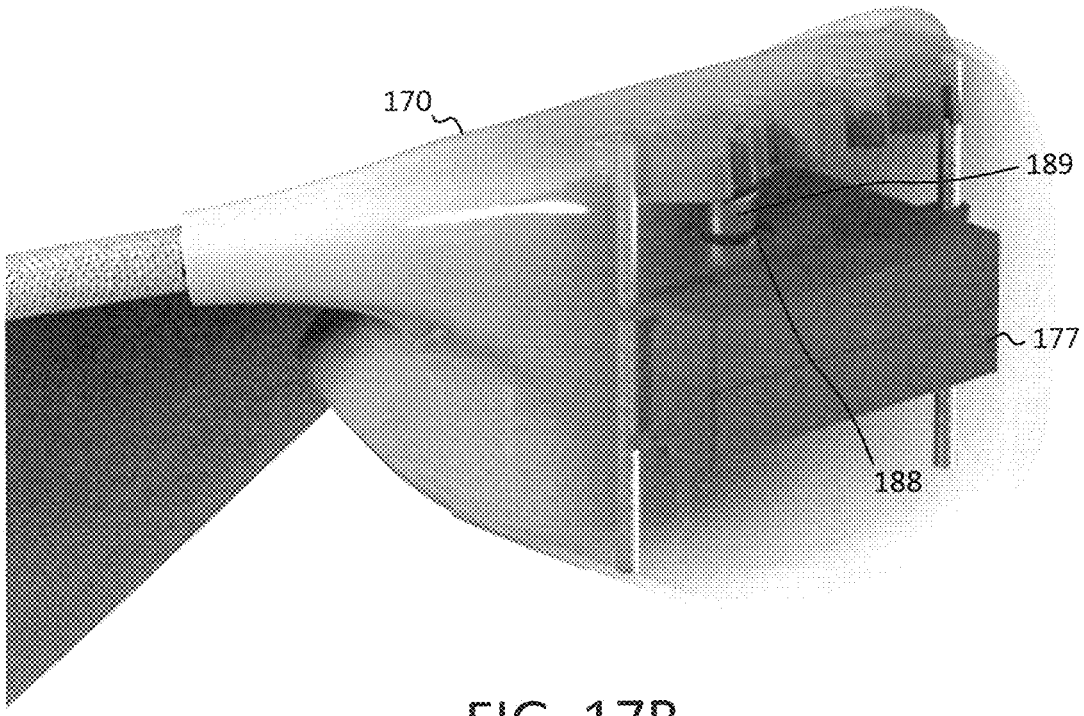
FIG. 17B is a front perspective view of a bouncer motor in a second position, according to an exemplary embodiment of the present subject disclosure.
Figure 18:
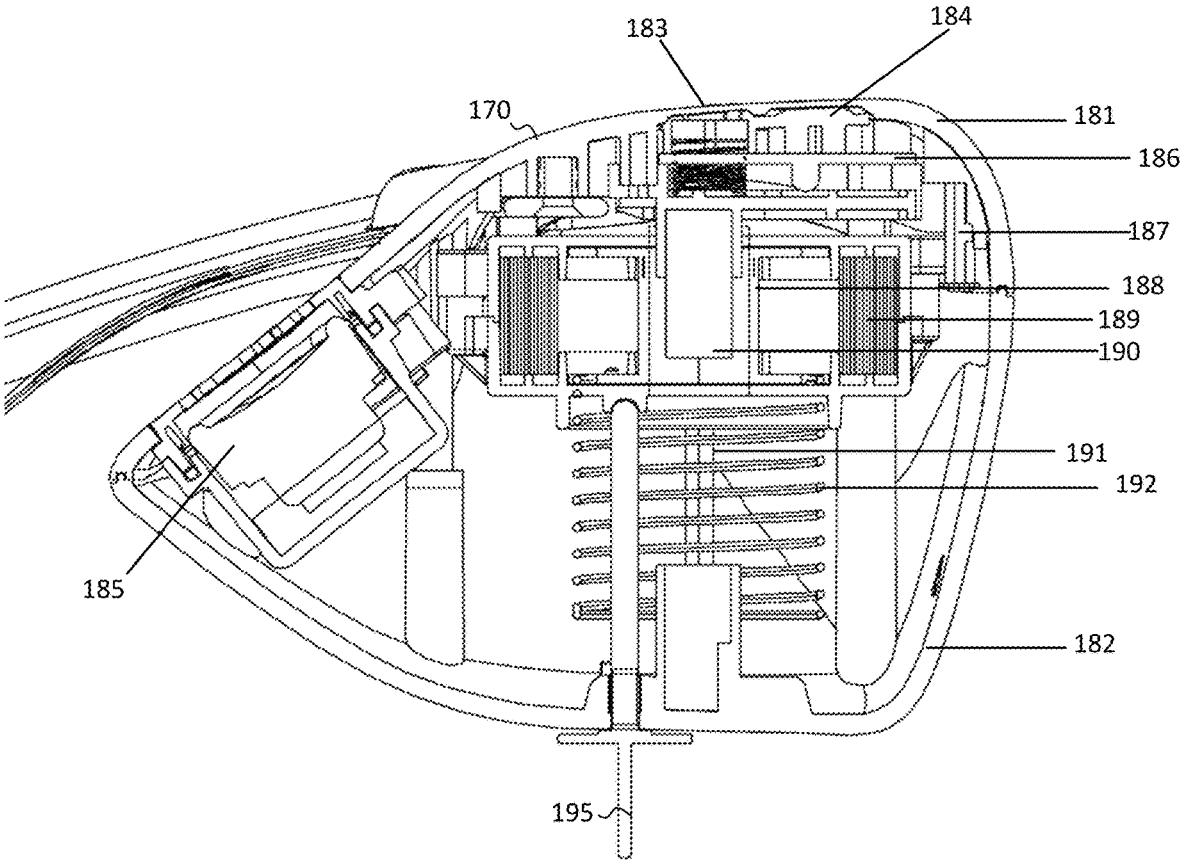
FIG. 18 is a cross sectional view of the interior of a motor housing, according to an exemplary embodiment of the present subject disclosure.

FIGS. 17A-17B and 18 show the basic functionality of the present subject disclosure. Motor housing 170 includes an upper housing 181 and lower housing 182. Touch keys 183 allow user to change variables and commands as desired. A display icon shade 184 provides visual feedback to the status of the motor. A speaker 185 may also provide audio feedback or be used to play pre-recorded melodies in conjunction with the motion of the bouncer 100. A main PCBA and control panel 186 provides pre-programmed and functioning steps to the motor.

When the rocking/bouncing function starts, there are pre-set electric pulses sent to the solenoid 188. A magnetic field created by the solenoid 188 would attract/repel the permanent magnet 189. This would drive the sliding box 177 (containing a steel counter weight 189), moving it up and down the spring frame 192 and hence be driven and start up the motion. When the spring frame 192 moves along metal shaft 191, the g-sensor 187 (which may be a MEMS inertial measurement unit) generates motion signal feedback to the microprocessor 186. The microprocessor 186 would process the signal by an algorithm and determine the instant when it reaches the highest and lowest position. When every time it identifies the highest/lowest position at the instant, it would generate an electric pulse and make the sliding box 177 punch up/down. This is a real-time cycle-to-cycle signal processing and motion generation process. By keep punching at the right moment (the highest/lowest position), the mechanism can adapt different oscillating frequencies with different user settings (i.e., bouncing/rocking mode and different weight of loading).

The functionality is an analogy of a playground swing. The child folds/unfolds her legs at the knees at the two swinging ends of the motion. The heavier child swings slower; the lighter child swings faster. The g-sensor 187 and the microprocessor 186 act like a brain and determine when the ends of the motion have been reached. By this method, the infant can swing smoothly no matter the weight.

When the motion reaches the natural frequency, the amplitude of motion would be optimum and it keeps rocking/bouncing steadily until it is turned off manually or by a timer. Once the motion is interrupted, it would go back to the pre-set pulses again for restarting the motion initially and re-catching the natural frequency and moving again.

FIGS. 17A, 17B, and 18 show further details of the bouncer motor. The bouncer motor may be disposed in a housing 170 that attaches to the frame 150. The housing 170 may be detachable in order to use the bouncer 100 manually and without the assistance of the bouncer motor. The bouncer motor may be a conventional motor or an electromagnetic motor that is driven by the repulsive magnetic force of two opposing magnets. A first magnetic element may be fixed, and a second magnetic element may be mobile along a set of support rails or other guide structure. The first magnet may be a permanent magnet and the second mobile magnet may be an electromagnet. This configuration may be switched so that the first magnet is an electromagnet, and the second magnet is a permanent magnet. Alternatively, either the first or second magnetic element may be a ferromagnetic metal or alloy that is attracted to a complementary magnet in order to move the housing and cause a bouncing or rocking motion.

The bouncer motor may be controlled by a controller 186 having a CPU and various bouncing and rocking routines stored in memory. The bouncing and rocking routines are responsible for the coordinated delivery of power to the bouncer motor in order to promote smooth bouncing or rocking motion during use. As different children have different weights and weight distributions and may move freely while they are secured in the bouncer, there is a large probability that the harmony of the bouncing or rocking motion may be easily disrupted during use. The controller 186 corrects the rhythm of the bouncing and rocking to negate any disruptive feedback and maintain harmonious motion. At least one sensor 187, such as a piezoelectric sensor, motion sensor, hall sensor, IR senor, G-sensor, optical sensor, inductive sensor, capacitive sensor or accelerometer, may be disposed in the housing 170 or with the bouncer motor in order to provide corrective feedback and cause smooth bouncing or rocking during use. The controlling, processing and sensing of the motor operation may be carried out by a system on a chip (SoC) or other traditional PCB-based PC architecture 186.

Figure 19A:
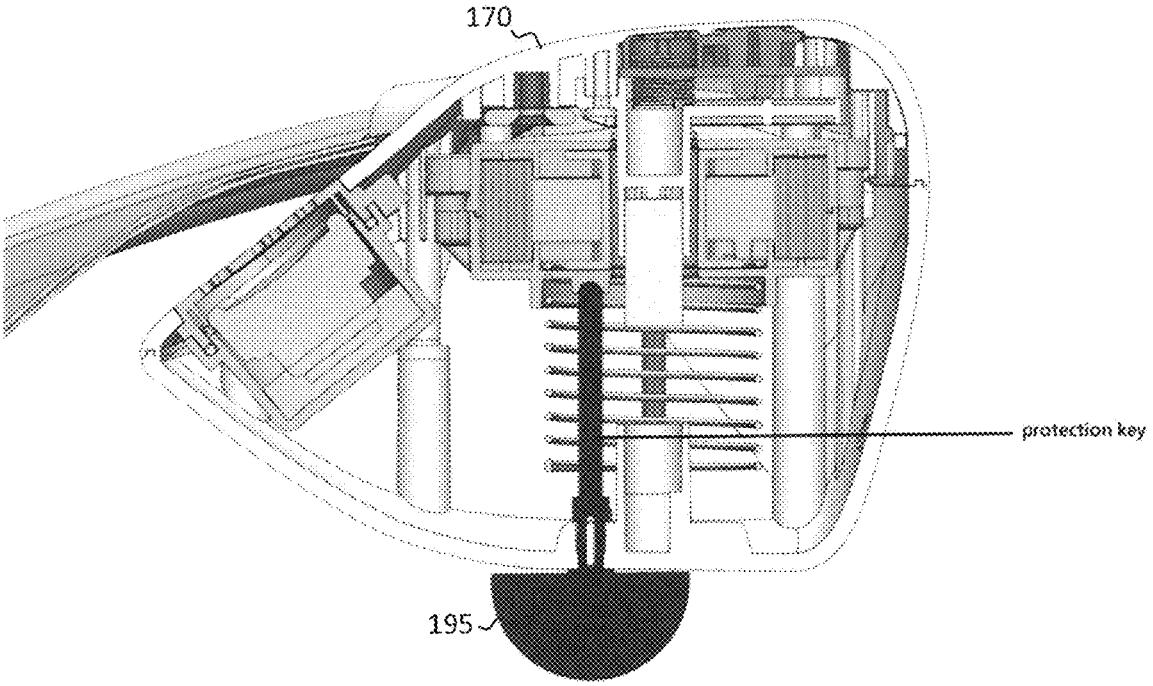
FIG. 19A is a cross sectional view of the interior of a motor housing with protection key, according to an exemplary embodiment of the present subject disclosure.
Figure 19B:
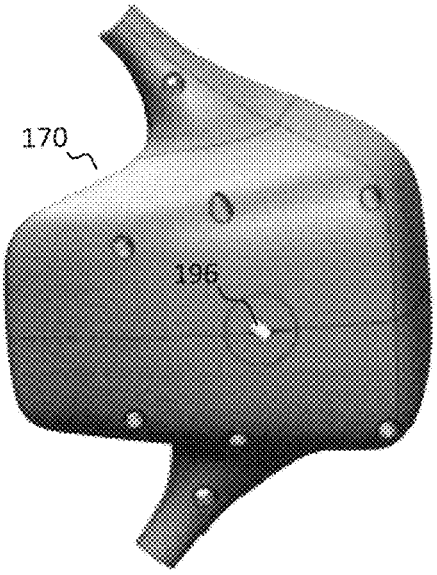
FIG. 19B is a bottom perspective view of a motor housing showing key hole, according to an exemplary embodiment of the present subject disclosure.
Figure 19C:
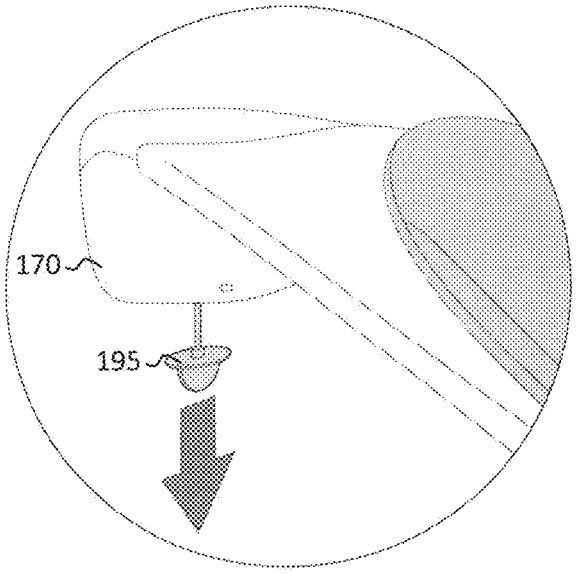
FIG. 19C is a side perspective view of a motor housing with protection key being removed, according to an exemplary embodiment of the present subject disclosure.

As shown in FIGS. 19A, 19B, and 19C, a locking key 195 may be inserted through a keyhole 196 disposed in the bottom of the housing 170 for immobilizing the bouncer motor during shipping or when bouncing assistance is not desired.

Figure 20:
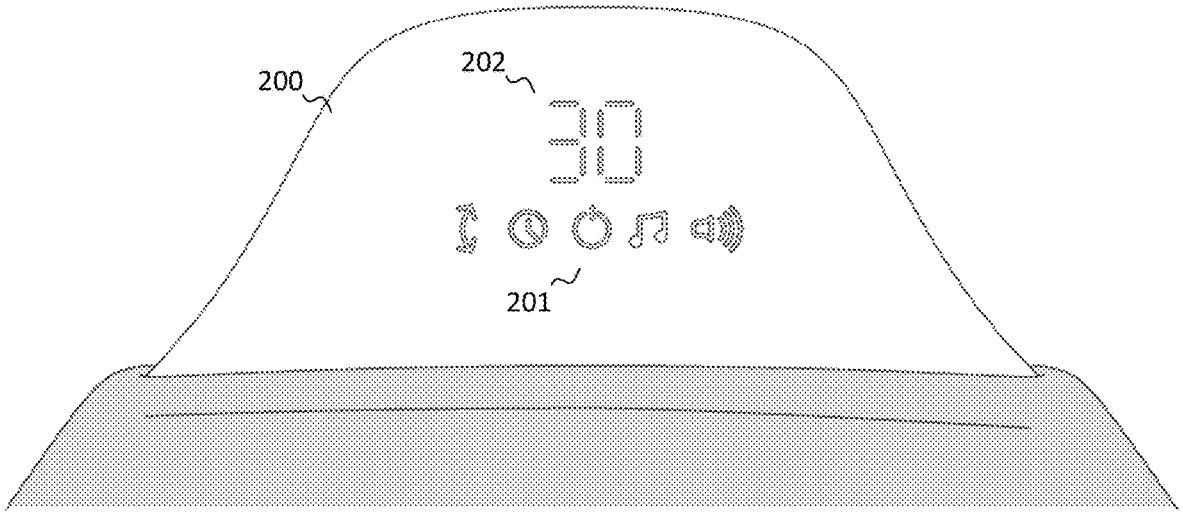
FIG. 20 is a front view of a control panel on a motor housing, according to an exemplary embodiment of the present subject disclosure.
Figure 21A:
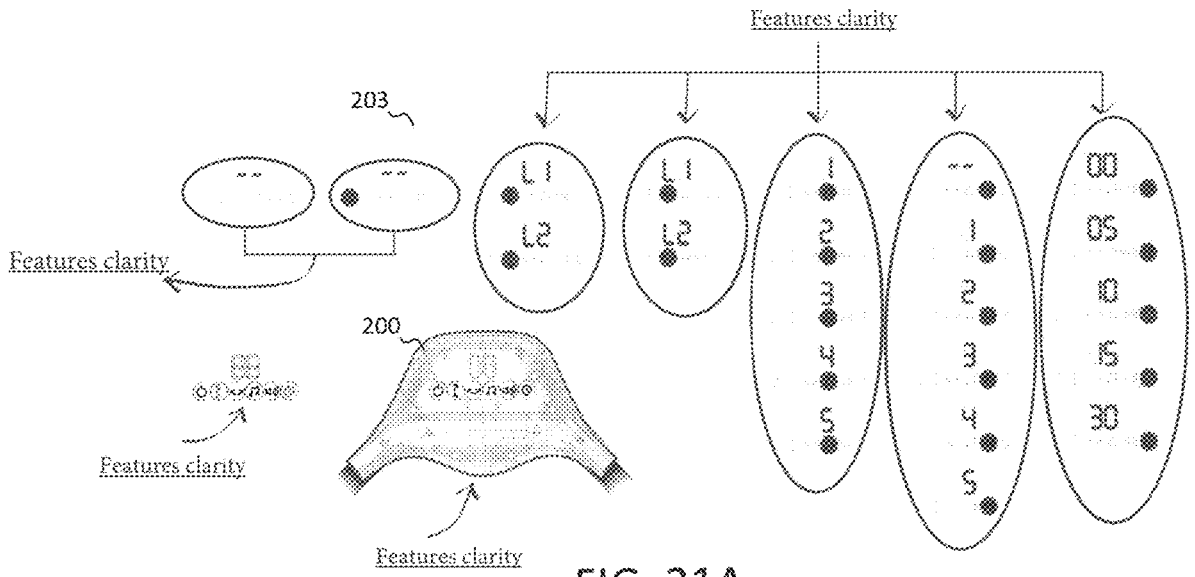
FIG. 21A is a ghost view of a control panel display showing sequence and logic for the bouncer motor, according to an exemplary embodiment of the present subject disclosure.
Figure 21B:
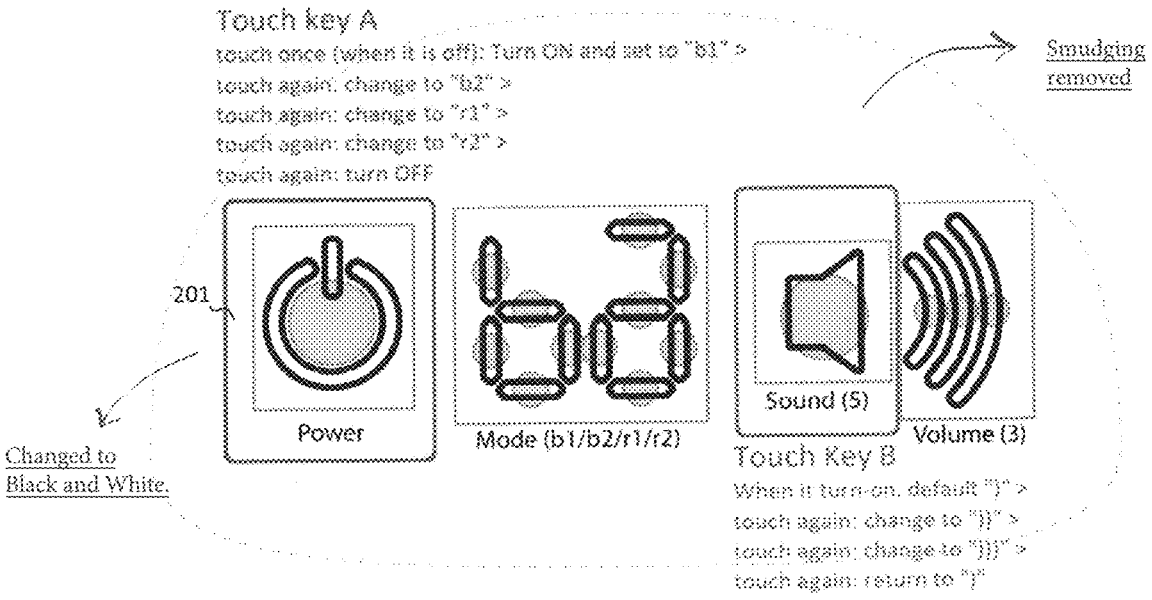
FIG. 21B is a front view of a control panel display sequence and logic for the bouncer motor and control panel, according to an exemplary embodiment of the present subject disclosure.

FIGS. 20, 21A, and 21B show various aspects and embodiments of the control panel display 200. The control panel 200 may be disposed on the bouncer motor housing 170. As shown in FIG. 20, the control panel 200 may include a touchscreen display and may provide a user with different controls 201 and information 202 related to the use of the baby bouncer. The control panel and interface 200 may be mechanical and include physical buttons or actuators. A power switch may be included in the control panel for turning the bouncer motor on or off. Additional display features may indicate whether a bouncing or rocking mode has been selected. The intensity of the bouncing or rocking motion may be adjusted and displayed to the user. Speakers may be included in the housing and controls for the volume and operation of the music options may be accessible from the control panel. At least one LED light source may be included, along with controls for different light intensities, colors, patterns, etc. A timer may be included, in addition to options for selecting various bouncing and rocking routines that may be stored in the memory and/or retrieved from remote servers or cloud storage.

The control panel 200 may include a transceiver for the remote operation of the baby bouncer with a remote or other control device (phone, tablet, laptop). Further, the control panel 200 may be wired or wirelessly connected to the pivoting legs 120 such that the position of the legs 120 provides information to the controller 200 as to which mode (bouncing or rocking) and options are available. The controller may be Bluetooth, WiFi or similarly network enabled for communication with other smart devices and IoT applications. The infant bouncer and rocker may utilize a universal networking IP-based connectivity protocol for IoT devices, such as Matter, Thread or Zigbee. Data related to the use of the baby bouncer may be stored locally or transmitted to remote servers for troubleshooting, optimization and signal processing to improve the operation of the baby bouncer and the user's experience. Software that controls the baby bouncer may be accessed through the control panel or within an application adapted for use with a phone or other smart device. The baby bouncer software application may allow a user to access different features and profiles for different use modes, and unique users and user characteristics. The use modes may include the bouncing and rocking routines, but also custom operating modes combining different music, light and activity goals for the infant. The software application may provide suggestions to the adult user based upon the data collected by the bouncer sensors and software application.

FIGS. 21A and 1B show various exemplary software routines and functionalities 203 of the control panel buttons 201. FIG. 21A shows the number of selections available for each button. For example, the "Bouncer" button which is the second button from the left, with the up and down arrow, has two selection levels. Same with the "Rocker" button which is the horizontal arrow to its right. FIG. 21B shows the LED locations which illuminate the icons and number segments from the back for visual communication to the user. These particular features and sequences may be pre-set within the controller or may be programmed by a user. The present subject disclosure is not limited to these features and sequences, and may have other features and sequences, which would be appreciated by one having skill in the art after consideration of the present subject disclosure.

The illustrations and examples provided herein are for explanatory purposes and are not intended to limit the scope of the appended claims. It will be recognized by those skilled in the art that changes, or modifications may be made to the above-described embodiments without departing from the broad inventive concepts of the invention. It is understood therefore that the invention is not limited to the particular embodiments which are described but is intended to cover all modifications and changes within the scope and spirit of the subject disclosure.

The foregoing disclosure of the exemplary embodiments of the present subject disclosure has been presented for purposes of illustration and description. It is not intended to be exhaustive or to limit the subject disclosure to the precise forms disclosed. Many variations and modifications of the embodiments described herein will be apparent to one of ordinary skill in the art in light of the above disclosure. The scope of the subject disclosure is to be defined only by the claims appended hereto, and by their equivalents.

Further, in describing representative embodiments of the present subject disclosure, the specification may have presented the method and/or process of the present subject disclosure as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present subject disclosure should not be limited to the performance of their steps in the order written, and one skilled in the art can readily appreciate that the sequences may be varied and still remain within the spirit and scope of the present subject disclosure.

What is claimed:

1. A combination bouncer and rocker device, comprising:

a base having a bottom surface that contacts a floor;

a pivoting leg attached to the base;

a frame attached to the base;

a bouncer motor attached to the frame;

an adjustment fitting for moving the frame relative to the base;

wherein the pivoting leg is adapted to pivot between a bouncing configuration and a rocking configuration; and a frame linkage that connects the frame to the base and connects the frame to the adjustment fitting.

2. The combination bouncer and rocker device of claim 1, wherein the base is U shaped.

3. The combination bouncer and rocker device of claim 2, comprising two pivoting legs, each pivoting leg attached to an end of the U-shaped base.

4. The combination bouncer and rocker device of claim 3, wherein each end of the pivoting leg has a gripping surface.

5. The combination bouncer and rocker device of claim 4, wherein in the bouncing configuration, the gripping surfaces of the legs face the same direction as the bottom surface of the U-shaped base.

6. The combination bouncer and rocker device of claim 5, wherein the bottom surface of the U-shaped frame has a cushion material that contacts the floor.

7. The combination bouncer and rocker device of claim 4, wherein in the rocking configuration, the gripping surfaces of the legs face each other and are perpendicular to the bottom surface of the U-shaped base.

8. The combination bouncer and rocker device of claim 7, wherein the bottom surface of the U-shaped frame and a side surface of the pivoting legs have a cushion material that contact the floor.

9. The combination bouncer and rocker device of claim 7, wherein the bottom surface of the U-shaped frame and the side surfaces of the pivoting legs that contact the floor are curvilinear.

10. The combination bouncer and rocker device of claim 1, wherein the frame linkage connects to the adjustment fitting at various positions which result in different height positions for the frame.

11. The combination bouncer and rocker device of claim 10, wherein the frame linkage connects to the adjustment fitting through a U-shaped bar.

12. The combination bouncer and rocker device of claim 1, further comprising a base linkage that connects the frame to the adjustment fitting.

13. The combination bouncer and rocker device of claim 1, further comprising a housing positioned at a top end of the frame and containing the bouncer motor.

14. The combination bouncer and rocker device of claim 13, wherein the bouncer motor uses magnetic power to create bounce and rocking motions.

15. The combination bouncer and rocker device of claim 14, further comprising a sensor in the housing and connected to the motor which detects movement of the frame and determines whether the movement is bouncing or rocking.

16. The combination bouncer and rocker device of claim 15, wherein the sensor provides detection information to a control unit which changes magnetic power signals to allow the bouncing or rocking movement to become rhythmic.

17. The combination bouncer and rocker device of claim 1, wherein a cross sectional plane of the frame is triangular.

18. A combination bouncer and rocker device, comprising:

a U-shaped base having a bottom surface that contacts a floor;

a pair of pivoting legs, each leg attached to an end of the base and including a gripping surface, wherein the pivoting legs are adapted to pivot between a bouncing configuration and a rocking configuration;

a frame attached to the base;

a bouncer motor attached to the frame;

an adjustment fitting for moving the frame relative to the base;

wherein in the bouncing configuration, the gripping surfaces of the legs face the same direction as the bottom surface of the U-shaped base; and wherein in the rocking configuration, the gripping surfaces of the legs face each other and are perpendicular to the bottom surface of the U-shaped base.

19. A combination bouncer and rocker device, comprising:

a U-shaped base having a bottom surface that contacts a floor;

a pair of pivoting legs, each leg attached to an end of the base and including a gripping surface, wherein the pivoting legs are adapted to pivot between a bouncing configuration and a rocking configuration;

a frame attached to the base;

a magnetic bouncer motor attached to the frame;

an adjustment fitting for moving the frame relative to the base;

a frame linkage that connects the frame to the base and connects the frame to the adjustment fitting; and a sensor connected to the motor which detects movement of the frame and determines whether the movement is bouncing or rocking, and provides detection information to a control unit which changes magnetic power to allow the bouncing or rocking movement to become rhythmic.

* * * * *